US005536632A

United States Patent [19]

Wen et al.

[11] Patent Number: 5,536,632

[45] Date of Patent: Jul. 16, 1996

[54] ULTRATHIN TABULAR GRAIN EMULSIONS WITH DOPANTS AT SELECTED LOCATIONS

[75] Inventors: Xin Wen; Richard L. Daubendiek, both of Rochester; Donald L. Black, Webster; Joseph C. Deaton, Rochester; Timothy R. Gersey, Rochester; Joseph G. Lighthouse, Rochester; Myra T. Olm, Webster; Robert D. Wilson, Rochester, all of N.Y.

[73] Assignee: Eastman Kodak Company, Rochester, N.Y.

[21] Appl. No.: 441,132

[22] Filed: May 15, 1995

[51] Int. Cl.[6] ..... G03C 1/035; G03C 1/09

[52] U.S. Cl. ..... 430/567; 430/604; 430/605; 430/570; 430/603

[58] Field of Search ..... 430/567, 603, 430/570, 604, 605

[56] References Cited

U.S. PATENT DOCUMENTS

| | | | |
|---|---|---|---|
| 4,435,501 | 3/1984 | Maksasky | 430/434 |
| 4,439,520 | 3/1984 | Kofron et al. | 430/434 |
| 4,814,264 | 3/1989 | Kishida et al. | 430/567 |
| 5,166,048 | 11/1992 | Wu | 430/569 |
| 5,250,403 | 10/1993 | Antoniades et al. | 430/505 |
| 5,275,930 | 1/1994 | Maskasky et al. | 430/567 |

FOREIGN PATENT DOCUMENTS

| | | | |
|---|---|---|---|
| 0498302A1 | 8/1992 | European Pat. Off. | G03C 1/035 |
| 0507702A1 | 10/1992 | European Pat. Off. | G03C 1/46 |
| 90/16014 | 12/1990 | WIPO | G03C 1/09 |

OTHER PUBLICATIONS

Buhr et al., Research Disclosure vol. 253, Item 25330, May 1985.

Research Disclosure vol. 308, Dec. 1989, Item 308119, Section I, Paragraph D.

Research Disclosure vol. 367, Nov. 1994, Item 36736.

*Primary Examiner*—Lee C. Wright

*Attorney, Agent, or Firm*—Carl O. Thomas

[57] ABSTRACT

A chemically and spectrally sensitized ultrathin tabular grain emulsion is disclosed including tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, and (e) exhibiting an average thickness of less than 0.07 μm.

Improved sensitivity is observed when the surface chemical sensitization sites include silver halide protrusions of a face centered cubic crystal lattice structure forming epitaxial junctions with the tabular grains and having a higher overall solubility than at least that portion of the tabular grains forming epitaxial junctions with the protrusions and a sensitivity enhancing combination of dopants are contained in the silver halide grains including a first sensitivity enhancing dopant capable of providing shallow electron trapping sites and a second sensitivity enhancing selenium dopant. To further enhance sensitivity, one of the sensitivity enhancing dopants is restricted to the tabular grains while the other is restricted to the silver halide epitaxy.

16 Claims, No Drawings

ULTRATHIN TABULAR GRAIN EMULSIONS WITH DOPANTS AT SELECTED LOCATIONS

FIELD OF THE INVENTION

The invention relates to silver halide photography. More specifically, the invention relates to improved spectrally sensitized silver halide emulsions and to multilayer photographic elements incorporating one or more of these emulsions.

BACKGROUND

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional modifying compounds, such as metal compounds, were taught to be optionally present during grain precipitation.

An early, cross-referenced variation on the teachings of Kofron et al was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver halide epitaxy to selected sites, typically the edges and/or corners, of the host grains. Depending upon the composition and site of the silver salt epitaxy, significant increases in speed were observed. Modifying compounds were taught to be optionally incorporated either in the host tabular grains or in the salt halide epitaxy.

In 1982 the first indirect radiographic and color photographic films incorporating the teachings of Kofron et al were introduced commercially. Now, 12 years later, there are clearly understood tabular grain emulsion preferences that are different, depending on the type of product being considered. Indirect radiography has found exceptionally thin tabular grain emulsions to be unattractive, since they produce silver images that have an objectionably warm (i.e., brownish black) image tone. In camera speed color photographic films exceptionally thin tabular grain emulsions usually have been found attractive, particularly when spectrally sensitized to wavelength regions in which native grain sensitivity is low—e.g., at wavelengths longer than about 430 nm. Comparable performance of exceptionally thin tabular grain emulsions containing one or more spectral sensitizing dyes having an absorption peak of less than 430 nm is theoretically possible. However, the art has usually relied on the native blue sensitivity of camera speed emulsions to boost their sensitivity, and this has retarded the transition to exceptionally thin tabular grain emulsions for producing blue exposure records. Grain volume reductions that result from reducing the thickness of tabular grains work against the use of the native blue sensitivity to provide increases in blue speed significantly greater than realized by employing blue absorbing spectral sensitizing dyes. Hence, thicker tabular grains or nontabular grains are a common choice for the blue recording emulsion layers of camera speed film.

Recently, Antoniades et al U.S. Pat. No. 5,250,403 disclosed tabular grain emulsions that represent what were, prior to the present invention, in many ways the best available emulsions for recording exposures in color photographic elements, particularly in the minus blue (red and/or green) portion of the spectrum. Antoniades et al disclosed tabular grain emulsions in which tabular grains having {111} major faces account for greater than 97 percent of total grain projected area. The tabular grains have an equivalent circular diameter (ECD) of at least 0.7 μm and a mean thickness of less-than 0.07 μm. Tabular grain emulsions with mean thicknesses of less than 0.07 μm are herein referred to as "ultrathin" tabular grain emulsions. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

A characteristic of ultrathin tabular grain emulsions that sets them apart from other tabular grain emulsions is that they do not exhibit reflection maxima within the visible spectrum, as is recognized to be characteristic of tabular grains having thicknesses in the 0.18 to 0.08 μm range, as taught by Buhr et al, Research Disclosure, Vol. 253, Item 25330, May 1985. Research Disclosure is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 μm range require care in selection, since their reflection properties differ widely within the visible spectrum. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsions not only allows improvements in photographic performance, it also offers the advantage of simplifying the construction of multilayer photographic elements. As one alternative Antoniades et al contemplated the incorporation of ionic dopants in the ultrathin tabular grains as taught by Research Disclosure, Vol. 308, December 1989, Item 308119, Section I, Paragraph D. Research Disclosure is published by Kenneth Mason Publications, Ltd., Dudley House, 12 North St., Emsworth, Hampshire P010 7DQ, England.

Dopants capable of increasing the speed of silver halide emulsions by providing shallow electron trapping sites are disclosed in Research Disclosure, Vol. 367, November 1994, Item 36736.

Wu U.S. Pat. No. 5,166,045 discloses employing selenium salts as dopants to enhance the sensitivity of silver halide grains.

Related Patent Applications

Daubendiek et al U.S. Ser. No. 359,251, filed Dec. 19, 1994, commonly assigned, titled EPITAXIALLY SENSI- TIZED ULTRATHIN TABULAR GRAIN EMULSIONS, now allowed, (Daubendiek et al I) discloses photographic performance advantages in chemically and spectrally sensitized ultrathin tabular grain emulsions in which the chemical sensitization includes silver salt protrusions forming epitaxial junctions with the ultrathin tabular grains. Daubendiek et al I is a continuation-in-part of Daubendiek et al II and III. The ultrathin tabular grains can contain a dopant providing shallow electron trapping sites and/or a selenium dopant.

Daubendiek et al U.S. Ser. No. 297,430, filed Aug. 26 1994, commonly assigned, titled ULTRATHIN TABULAR GRAIN EMULSIONS CONTAINING SPEED-GRANULARITY ENHANCEMENTS, now allowed, (Daubendiek et al II) observes in addition to the photographic performance advantages of Daubendiek et al I improvements in speed-granularity relationships attributable to the combination of chemical sensitizations including silver salt epitaxy and iodide distributions in the host tabular grains profiled so that the higher iodide host grain concentrations occur adjacent the corners and edges of the tabular grains and preferentially receive the silver salt epitaxy.

Daubendiek et al U.S. Ser. No. 297,195, filed Aug. 26, 1994, commonly assigned, titled ULTRATHIN TABULAR GRAIN EMULSIONS WITH SENSITIZATION ENHANCEMENTS, (Daubendiek et al III) observes additional photographic advantages, principally increases in speed and contrast, to be realized when the iodide concentration of the silver halide epitaxy on silver iodobromide ultrathin tabular grains is increased.

King et al U.S. Ser. No. 336,817, filed Nov. 9, 1994, commonly assigned, titled AN IMPROVED EMULSION AND PHOTOGRAPHIC ELEMENT, now allowed, discloses a spectrally sensitized ultrathin tabular grain emulsion in which the tabular grains contain a dopant capable of providing shallow electron trapping sites, surface chemical sensitization sites have been formed at least in part by reduction sensitization, and the spectral sensitizing exhibits an oxidation potential more positive than 1.2 volts.

Problem to be Solved

Notwithstanding the many advantages of tabular grain emulsions in general and the specific improvements represented by ultrathin tabular grain emulsions and color photographic elements, including those disclosed by Antoniades et al, there has remained an unsatisfied need for performance improvements in ultrathin tabular grain emulsions heretofore unavailable in the art as well as photographic elements containing these emulsions and for alternative choices for constructing emulsions and photographic elements of the highest attainable performance characteristics for color photography.

In addition there is a need in the art for ultrathin tabular grain emulsions that are "robust", where the term "robust" is employed to indicate the emulsion remains close to aim (i.e., planned) photographic characteristics despite inadvertent manufacturing variances. It is not uncommon to produce photographic emulsions that appear attractive in terms of their photographic properties when produced under laboratory conditions only to find that small, inadvertent variances in manufacturing procedures result in large quantities of emulsions that depart from aim characteristics to such an extent they cannot satisfy commercial requirements. There is in the art a need for high performance tabular grain emulsions that exhibit high levels of robustness or aim inertia, varying little from aim photographic characteristics from one manufacturing run to the next.

In attempting to modify the performance of ultrathin tabular grain emulsions through the inclusion of combinations of dopants in the ultrathin tabular grains, maximum sensitivity levels have been observed. Thus, another problem to be solved is to provide ultrathin tabular grain emulsions containing the same combinations of dopants, but with higher sensitivities than the maximum levels observed by incorporating the dopants in the ultrathin tabular grains.

SUMMARY OF THE INVENTION

In one aspect the invention is directed to a radiation-sensitive emulsion comprised of a dispersing medium, silver halide grains including tabular grains, the tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, and (e) exhibiting an average thickness of less than 0.07 μm, latent image forming chemical sensitization sites on the surfaces of the tabular grains, and a spectral sensitizing dye adsorbed to the surfaces of the tabular grains, wherein the surface chemical sensitization sites include silver halide protrusions of a face centered cubic crystal lattice structure forming epitaxial junctions with the tabular grains and having a higher overall solubility than at least that portion of the tabular grains forming epitaxial junctions with the protrusions and a sensitivity enhancing combination of dopants are contained in the silver halide grains including a first sensitivity enhancing dopant capable of providing shallow electron trapping sites and a second sensitivity enhancing selenium dopant, and, to enhance sensitivity, one of the first and second sensitivity enhancing dopants is restricted to the tabular grains and another of the first and second sensitivity enhancing dopants is restricted to the silver halide epitaxy.

In another aspect this invention is directed to a photographic element comprised of (i) a support, (ii) a first silver halide emulsion layer coated on the support and sensitized to produce a photographic record when exposed to specular light within the minus blue visible wavelength region of from 500 to 700 nm, and (iii) a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to the invention.

The improved ultrathin tabular grain emulsions of the present invention are the first to employ sensitivity enhancing dopants in the ultrathin tabular grains and dopant modified silver halide epitaxy in their chemical sensitization. The present invention has been realized by overcoming a bias in the art against applying silver halide epitaxial sensitization to ultrathin tabular grain emulsions. Conspicuously absent from the teachings of Antoniades et al are demonstrations or suggestions of the suitability of silver halide epitaxial sensitizations of the ultrathin tabular grain emulsions therein disclosed. Antoniades et al was, of course, aware of the teachings of Maskasky I, but correctly observed that Maskasky I provided no explicit teaching or examples applying silver halide epitaxial sensitizations to ultrathin tabular grain emulsions. Having no original observations to rely upon and finding no explicit teaching of applying silver halide sensitization to ultrathin tabular grain emulsions, Antoniades et al was unwilling to speculate on the possible suitability of such sensitizations to the ultrathin tabular grain emulsions disclosed. The much larger surface to volume ratios exhibited by ultrathin tabular grains as compared to those employed by Maskasky I in itself was enough to raise significant doubt as to whether the ultrathin structure of the tabular grains could be maintained during epitaxial silver halide deposition. Further, it appeared intuitively obvious that the addition of silver halide epitaxy to ultrathin tabular grain emulsions would not improve image sharpness, either in the emulsion layer itself or in an underlying emulsion layer.

It has been discovered that chemical sensitizations including doped silver halide epitaxy and sensitivity enhancing doping of the ultrathin tabular grains are not only compatible with ultrathin host tabular grains, but that the resulting emulsions show improvements which were wholly unexpected, either in degree or in kind. Restricting one of the sensitivity enhancing dopants to the silver halide epitaxy and restricting the other of the sensitivity enhancing dopants to the tabular grains results in much higher speeds than can be realized when both dopants are present in either of these two locations.

Increases in sensitivity imparted to ultrathin tabular grain emulsions by silver halide epitaxy have been observed to be larger than were expected based on the observations of Maskasky I employing thicker tabular host grains.

Additionally, the emulsions of the invention exhibit higher than expected contrasts.

At the same time, the anticipated unacceptable reductions in image sharpness, investigated in terms of specularity measurements, simply did not materialize, even when the quantities of silver salt epitaxy were increased well above the preferred maximum levels taught by Maskasky I.

Still another advantage is based on the observation of reduced unwanted wavelength absorption as compared to relatively thicker tabular grain emulsions similarly sensitized. A higher percentage of total light absorption was confined to the spectral region in which the spectral sensitizing dye or dyes exhibited absorption maxima. For minus blue sensitized ultrathin tabular grain emulsions native blue absorption was also reduced.

Finally, the emulsions investigated have demonstrated an unexpected robustness. It has been demonstrated that, when levels of spectral sensitizing dye are varied, as can occur during manufacturing operations, the silver salt epitaxially sensitized ultrathin tabular grain emulsions of the invention exhibit less variance in sensitivity than comparable ultrathin tabular grain emulsions that employ only sulfur and gold sensitizers.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional ultrathin tabular grain emulsion in which the tabular grains (a) have {111} major faces;

(b) contain greater than 70 mole percent bromide, based on silver, (c) account for greater than 90 percent of total grain projected area;

(d) exhibit an average ECD of at least 0.7 μm; and (e) exhibit-an average thickness of less than 0.07 μm.

Although criteria (a) through (e) are too stringent to be satisfied by the vast majority of known tabular grain emulsions, a few published precipitation techniques are capable of producing emulsions satisfying these criteria. Antoniades et al, cited above and here incorporated by reference, demonstrates preferred silver iodobromide emulsions satisfying these criteria. Zola and Bryant published European patent application 0 362 699 A3, also discloses silver iodobromide emulsions satisfying these criteria.

In referring to grains and emulsions containing more than one halide, the halides are named in their order of ascending concentration.

For camera speed films it is generally preferred that the tabular grains contain at least 0.25 (preferably at least 1.0) mole percent iodide, based on silver. Although the saturation level of iodide in a silver bromide crystal lattice is generally cited as about 40 mole percent and is a commonly cited limit for iodide incorporation, for photographic applications iodide concentrations seldom exceed 20 mole percent and are typically in the range of from about 1 to 12 mole percent.

As is generally well understood in the art, precipitation techniques, including those of Antoniades et al and Zola and Bryant, that produce silver iodobromide tabular grain emulsions can be modified to produce silver bromide tabular grain emulsions of equal or lesser mean grain thicknesses simply by omitting iodide addition. This is specifically taught by Kofron et al.

It is possible to include minor amounts of chloride ion in the ultrathin tabular grains. As disclosed by Delton U.S. Pat. No. 5,372,927, here incorporated by reference, and Delton U.S. Ser. No. 238,119, filed May 4, 1994, titled CHLORIDE CONTAINING HIGH BROMIDE ULTRATHIN TABULAR GRAIN EMULSIONS, now abandoned in favor of continuation-in-part U.S. Ser. No. 08/304,034, filed Sep. 9, 1994, now U.S. Pat. No. 5,460,934, both patents commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (°C.) boundaries of Curve A (preferably within the boundaries of Curve B) shown by Delton, corresponding to Curves A and B of Piggin et al U.S. Pat. Nos. 5,061,609 and 5,061,616, the disclosures of which are here incorporated by reference. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

For reasons discussed below in connection with silver salt epitaxy the ultrathin tabular grains accounting for at least 90 percent of total grain projected area contain at least 70 mole percent bromide, based on silver. These ultrathin tabular grains include silver bromide, silver iodobromide, silver chlorobromide, silver iodochlorobromide and silver chloroiodobromide grains. When the ultrathin tabular grains include iodide, the iodide can be uniformly distributed within the tabular grains. To obtain a further improvement in speed-granularity relationships it is preferred that the iodide distribution satisfy the teachings of Solberg et al U.S. Pat. No. 4,433,048, the disclosure of which is here incorporated by reference. The application of the iodide profiles of Solberg et al to ultrathin tabular grain emulsions is the specific subject matter of Daubendiek et al II, cited above. All references to the composition of the ultrathin tabular grains exclude the silver salt epitaxy.

The ultrathin tabular grains produced by the teachings of Antoniades et al, Zola and Bryant and Delton all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Ultrathin tabular grain emulsions in which the tabular grains account for greater than 97 percent of total grain projected area can be produced by the preparation procedures taught by Antoniades et al and are preferred. Antoniades et al reports emulsions in which substantially all (e.g., up to 99.8%) of total grain projected area is accounted for by tabular grains. Similarly, Delton reports that "substantially all" of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD of at least 0.7 μm. The advantage to be realized by maintaining the average ECD of at least 0.7 μm is demonstrated in Tables III and IV of Antoniades et al. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions of the invention the tabular grains accounting for greater than 90 percent of total grain projected area exhibit a mean thickness of less than 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20Å) have been observed in the emulsions of Antoniades et al, Kofron et al suggests a practical minimum tabular grain thickness about 0.01 μm.

Preferred ultrathin tabular grain emulsions are those in which grain to grain variance is held to low levels. Antoniades et al reports ultrathin tabular grain emulsions in which greater than 90 percent of the tabular grains have hexagonal major faces. Antoniades also reports ultrathin tabular grain emulsions exhibiting a coefficient of variation (COV) based on ECD of less than 25 percent and even less than 20 percent.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger-ECD grains in the ultrathin tabular grain emulsions of the invention can produce a significant increase in emulsion granularity. Antoniades et al preferred low COV emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to modify the ultrathin tabular grain precipitation procedures taught by Antoniades et al to decrease selectively the size-frequency distribution of the ultrathin tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of ultrathin tabular grains having greater than mean ECD's (hereinafter referred to as the $>ECD_{av}$ grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed.

Maskasky U.S. Pat. No. 4,713,320 (hereinafter referred to as Maskasky II), here incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky II employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfate of one of the following formulae:

$$R—SO_2S—M \quad (I)$$

$$R—SO_2S—R^1 \quad (II)$$

$$R—SO_2S—Lm—SSO_2—R^2 \quad (III)$$

where R, $R^1$ and $R^2$ are either the same or different and represent an aliphatic group, an aromatic group, or a heterocyclic group, M represents a cation, L represents a divalent linking group, and m is 0 or 1, wherein R, $R^1$, $R^2$ and L combine to form a ring. Gelatino-peptizers include gelatin—e.g., alkali-treated gelatin (cattle, bone or hide gelatin) or acid-treated gelatin (pigskin gelatin) and gelatin derivatives, e.g., acetylated or phthalated gelatin.

Subject to modifications specifically described below, preferred techniques for chemical and spectral sensitization are those described by Maskasky I, cited above and here incorporated by reference. Maskasky I reports improvements in sensitization by epitaxially depositing silver salt at selected sites on the surfaces of the host tabular grains. Maskasky I attributes the speed increases observed to restricting silver salt epitaxy deposition to a small fraction of the host tabular grain surface area. Specifically, Maskasky I teaches to restrict silver salt epitaxy to less than 25 percent, preferably less than 10 percent, and optimally less than 5 percent of the host grain surface area. Although the observations of this invention in general corroborate increasing photographic sensitivity as the percentage of host tabular grain surface area occupied by epitaxy is restricted, silver salt epitaxy has been found to be advantageous even when its location on the host tabular grains is not significantly restricted. This is corroborated by the teachings of Chen et al published European patent application 0 498 302, here incorporated by reference, which discloses high solubility silver halide protrusions on silver halide host tabular grains occupying up to 100 percent of the host tabular grain surface area. Therefore, in the practice of this invention restriction of the percentage of host tabular grain surface area occupied by silver salt epitaxy is viewed as a preference rather than a requirement of the invention. However, it is preferred that the silver salt epitaxy occupy less than 50 percent of the host tabular grain surface area.

Like Maskasky I, nominal amounts of silver salt epitaxy (as low as 0.05 mole percent, based on total silver, where total silver includes that in the host and epitaxy) are effective in the practice of the invention. Because of the increased host tabular grain surface area coverages by silver salt epitaxy discussed above and the lower amounts of silver in ultrathin tabular grains, an even higher percentage of the total silver can be present in the silver salt epitaxy. However, in the absence of any clear advantage to be gained by increasing the proportion of silver salt epitaxy, it is preferred that the silver salt epitaxy be limited to 50 percent of total silver. Generally silver salt epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver salt epitaxy that can be applied in forming the emulsions of this invention. Maskasky I teaches employing spectral sensitizing dyes that are in their aggregated form of adsorption to the tabular grain surfaces capable of direct silver salt epitaxy to the edges or corners of the tabular grains. Cyanine dyes that are adsorbed to host ultrathin tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

To avoid structural degradation of the ultrathin tabular grains it is generally preferred that the silver salt epitaxy be of a composition that exhibits a higher overall solubility than the overall solubility of the silver halide or halides forming the ultrathin host tabular grains. The overall solubility of mixed silver halides is the mole fraction weighted average of the solubilities of the individual silver halides. This is one reason for requiring at least 70 mole percent bromide, based on silver, in the ultrathin tabular grains. Because of the large differences between the solubilities of the individual silver halides, the iodide content of the host tabular grains will in the overwhelming majority of instances be equal to or greater than that of the silver salt epitaxy. Silver chloride is a specifically preferred silver salt for epitaxial deposition onto the host ultrathin tabular grains. Silver chloride, like silver bromide, forms a face centered cubic lattice structure, thereby facilitating epitaxial deposition. There is, however, a difference in the spacing of the lattices formed by the two halides, and it is this difference that creates the epitaxial junction believed responsible for at least a major contribution to increased photographic sensitivity. To preserve the structural integrity of the ultrathin tabular grains epitaxial deposition is preferably conducted under conditions that restrain solubilization of the halide forming the ultrathin tabular grains. For example, the minimum solubility of silver bromide at 60° C. occurs between a pBr of between 3 and 5, with pBr values in the range of from about 2.5 to 6.5 offering low silver bromide solubilities. Nevertheless, it is contemplated that to a limited degree, the halide in the silver salt epitaxy will be derived from the host ultrathin tabular grains. Thus, silver chloride epitaxy containing minor amounts of bromide and, in some instances, iodide is specifically contemplated.

Silver bromide epitaxy on silver chlorobromide host tabular grains has been demonstrated by Maskasky I as an example of epitaxially depositing a less soluble silver halide on a more soluble host and is therefore within the contemplation of the invention, although not a preferred arrangement.

Maskasky I discloses the epitaxial deposition of silver thiocyanate on host tabular grains. Silver thiocyanate epitaxy, like silver chloride, exhibits a significantly higher solubility than silver bromide, with or without minor amounts of chloride and/or iodide. An advantage of silver thiocyanate is that no separate site director is required to achieve deposition selectively at or near the edges and/or corners of the host ultrathin tabular grains. Maskasky U.S. Pat. No. 4,471,050, incorporated by reference and hereinafter referred to as Maskasky III, includes silver thiocyanate epitaxy among various nonisomorphic silver salts that can be epitaxially deposited onto face centered cubic crystal lattice host silver halide grains. Other examples of self-directing nonisomorphic silver salts available for use as epitaxial silver salts in the practice of the invention include β phase silver iodide, γ phase silver iodide, silver phosphates (including meta- and pyro-phosphates) and silver carbonate.

It is generally accepted that selective site deposition of silver salt epitaxy onto host tabular grains improves sensitivity by reducing sensitization site competition for conduction band electrons released by photon absorption on imagewise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular grains. The spacing of the corners of the major faces of the host ultrathin tabular grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain.

Silver salt epitaxy can by itself increase photographic speeds to levels comparable to those produced by substantially optimum chemical sensitization with sulfur and/or gold. Additional increases in photographic speed can be realized when the tabular grains with the silver salt epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver salt epitaxy sensitizations are contained in Research Disclosure December 1989, Item 308119, Section III. Chemical sensitization. Kofron et al illustrates the application of these sensitizations to tabular grain emulsions.

A specifically preferred approach to silver salt epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

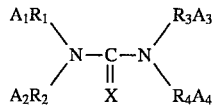

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl- 1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad (V)$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver salt epitaxial deposition. Maskasky I teaches the use of aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the ultrathin tabular grain emulsions of the invention. A more general summary of useful spectral sensitizing dyes is provided by Research Disclosure, December 1989, Item 308119, Section IV. Spectral sensitization and desensitization, A. Spectral sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of the invention emulsions produce very large speed increases. This is in part attributable to relatively lower mean grain volumes and in part to the relatively higher mean grain surface areas available for spectral sensitizing dye adsorption.

In addition to the silver halide epitaxially deposited on the host ultrathin tabular grains, the grains are sensitized by a combination of dopants. A first sensitivity enhancing dopant is chosen to provide shallow electron trapping sites. A second sensitivity enhancing dopant is a selenium dopant. It has been discovered that unexpectedly high levels of sensitivity are realized when one of the first and second dopants is located in the silver halide epitaxy and the remaining of the dopants is located in the ultrathin tabular grains.

Preferred selenium dopants are of the type disclosed by Wu U.S. Pat. No. 5,166,045, the disclosure of which is here incorporated by reference. During precipitation of the grain portion in which the selenium dopant is to be located, a selenium donating substance is present. The selenium can be incorporated in an elemental form—i.e., $Se^o$—or in a divalent form in either an organic or inorganic compound. Specifically preferred inorganic compounds can take the following form:

$$M—Se—L \quad (VI)$$

where

M is a monovalent metal, such as an alkali metal, and

L is halogen or pseudohalogen.

The halogen can be selected from among fluoride, chloride and bromide. The term "pseudohalogen" is employed in its art recognized usage to indicate ligands that are reactively similar to halogen and are at least as electronegative as halogen. Preferably L completes with Se a selenocyanate or isoselenocyanate moiety.

In preferred organic selenium source compounds either —Se— or Se= bonding patterns can be present, with the selenium atom typically being bonded to carbon, nitrogen or phosphorus. Carbon, nitrogen or phosphorus bonds not satisfied by selenium can be satisfied by hydrogen or organic moieties, such as substituted or unsubstituted alkyl or aryl moieties containing up to about 10 carbon atoms. Lower alkyl (<6 carbon atoms and optimally <4 carbon atoms) are preferred while preferred aryl moieties are those containing from 6 to 10 carbon atoms, such as phenyl lower alkyl substituted phenyl moieties.

Specific illustrations of selenium dopant source materials for inclusion during precipitation include the following:

| | |
|---|---|
| Se-1 | Colloidal selenium |
| Se-2 | Potassium selenocyanate |
| Se-3 | Selenoacetone |
| Se-4 | Selenoacetophenone |
| Se-5 | Selenourea |
| Se-6 | Tetramethylselenourea |
| Se-7 | N-(β-carboxyethyl)-N',N'-dimethylselenourea |
| Se-8 | N,N-dimethylselenourea |
| Se-9 | Selenoacetamide |
| Se-10 | Diethylselenide |
| Se-11 | Diphenylselenide |
| Se-12 | Bis(2,4,6-trimethylphenyl)selenide |
| Se-13 | Triphenylphosphine selenide |
| Se-14 | Tri-p-tolylselenophosphate |
| Se-15 | Tri-n-butylselenophosphate |
| Se-16 | 2-Selenopropionic acid |
| Se-17 | 3-Selenobutyric acid |
| Se-18 | Methyl-3-selenobutyrate |
| Se-19 | Allyl isoselenocyanate |
| Se-20 | N,N'-Dioctylselenourea |

Preferred concentrations of the selenium dopants are in the range of from $1\times10^{-6}$ to $7\times10^{-5}$ mole per silver mole, where silver represents total silver—that is, silver in the ultrathin tabular grains and in the silver halide epitaxy.

A variety of dopants that enhance photographic sensitivity by providing shallow electron trapping sites, hereinafter referred to as SET dopants, have been empirically identified over the years. Recently the first comprehensive explanation of the structural requirements of an SET dopant was set out in Research Disclosure, Item 36736, cited above. When a photon is absorbed by a silver halide grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of $Ag^o$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the silver halide to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal Advances in Physics, Vol. 37 (1988) p. 395 and Excitonic Processes in Solids by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV).

For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectro-chemical series of ligands, derived from the absorption spectra of metal ion complexes in solution, referenced in Inorganic Chemistry: Principles of Structure and Reactivity, by James E. Huheey, 1972, Harper and Row, New York and in Absorption Spectra and Chemical Bonding in Complexes by C. K. Jorgensen, 1962, Pergamon Press, London. From these references the following order of ligands in the spectrochemical series is apparent:

$$I^- < Br^- < S^{-2} < \underline{S}CN^- < Cl^- < NO_3^- < F^- < \underline{O}H$$

$$< ox^{-2} < H_2\underline{O} < \underline{N}CS^- < CH_3C\underline{N}^- < \underline{N}H_3 < en < dipy$$

$$< phen < \underline{N}O_2^- < phosph << \underline{C}N^- < \underline{C}O.$$

The abbreviations used are as follows: ox= oxalate, dipy= dipyridine, phen= o-phenathroline, and phosph=4-methyl-2, 6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), seleno-cyanate ( $\underline{N}CSe^-$), cyanate ($\underline{N}CO^-$), tellurocyanate ($\underline{N}CTe^-$) and azide ($N_3^-$).

Just as the spectrochemical series can be applied to ligands of coordination complexes, it can also be applied to the metal ions. The following spectrochemical series of metal ions is reported in Absorption Spectra and Chemical Bonding by C. K. Jorgensen, 1962, Pergamon Press, London:

$$Mn^{+2} < Ni^{+2} < Co^{+2} < Fe^{+2} < Cr^{+3}$$

$$\approx V^{+3} < Co^{+3} < Mn^{+4} < Mo^{+3} < Rh^{+3}$$

$$\approx Ru^{+3} < Pd^{+4} < Ir^{+3} < Pt^{+4}$$

The metal ions in boldface type satisfy frontier orbital requirement (1) above. Although this listing does not contain all the metal ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in Electron Spin Resonance: A Comprehensive Treatise on Experimental Techniques, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal Physica Status Solidi(b), Vol. 152 (1989), pp. 583–592, in a AgCl crystal the g factor of the electron EPR signal is $1.88 \pm 0.001$ and in AgBr it is $1.49 \pm 0.02$.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a $0.45 \pm 0.05$ μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K, respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588, the disclosures of which are here incorporated by reference. Useful neutral and anionic organic ligands for hexacoordination complexes are disclosed by Olm et al U.S. Pat. No. 5,360,712, the disclosure of which is here incorporated by reference. Careful scientific investigations have revealed Group VIII hexahalo coordination complexes to create deep (desensitizing) electron traps, as illustrated R. S. Eachus, R. E. Graves and M. T. Olm J. Chem. Phys., Vol. 69, pp. 4580–7 (1978) and Physica Status Solidi A, Vol. 57, 429–37 (1980).

In a specific, preferred form it is contemplated to employ as a dopant a hexacoordination complex satisfying the formula:

$$[ML_6]^n \qquad \text{(VII)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that at least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

It is additionally contemplated to employ oligomeric coordination SET complexes to increase speed, as taught by Evans et al U.S. Pat. No. 5,024,931, the disclosure of which is here incorporated by reference.

The SET dopants are effective in conventional concentrations, where concentrations are based on the total silver, including both the silver in the tabular grains and the silver in the protrusions. Preferably SET dopants are contemplated to be incorporated in concentrations of at least $1\times10^{-6}$ mole per silver mole up to their solubility limit, typically up to about $5\times10^{-4}$ mole per silver mole. Specifically preferred concentrations are in the range of from about $10^{-5}$ to $10^{-4}$ mole per silver mole.

It has been discovered quite unexpectedly that higher photographic speeds are realized when the selenium dopant and the SET dopant are located in different portions of the grains. It is specifically preferred to restrict SET dopant incorporation to the ultrathin tabular grains and to restrict incorporation of the selenium dopant to the silver halide epitaxy. However, it is believed that an overall sensitivity superior to that obtained by placing both dopants in the silver halide epitaxy and both in the ultrathin tabular grains can also be realized when the selenium dopant is restricted to incorporation in the ultrathin tabular grains and the SET dopant is restricted to incorporation in the silver halide epitaxy.

Aside from the features of spectral sensitized, silver salt epitaxy sensitized ultrathin tabular grain emulsions described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in Research Disclosure, Vol. 365, September 1994, Item 36544, Section I, Paragraph E, the disclosure of which is here incorporated by reference.

The emulsions once formed can be further prepared for photographic use by any convenient conventional technique. Additional conventional features are illustrated by Research Disclosure Item 36544, cited above, Section II, Vehicles, vehicle extenders, vehicle-like addenda and vehicle related addenda; Section III, Emulsion washing; Section V, Spectral sensitization and desensitization; Section VI, UV dyes/optical brighteners/luminescent dyes; Section VII, Antifoggants and stabilizers; Section VIII, Absorbing and scattering materials; Section IX, Coating physical property modifying addenda; Section X, Dye image formers and modifiers. The features of Sections VI, VIII, IX and X can alternatively be provided in other photographic element layers. Other features which relate to photographic element construction are found in Section XI, Layers and layer arrangements; XII, Features applicable only to color negative; XIII, Features applicable only to color reversal; XIV, Scan facilitating features; and XV, Supports.

The novel epitaxial silver salt sensitized ultrathin tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one important aspect this invention is directed to a photographic element containing at least two superimposed radiation sensitive silver halide emulsion layers coated on a conventional photographic support of any convenient type. The emulsion layer coated nearer the support surface is spectrally sensitized to produce a photographic record when the photographic element is exposed to specular light within the minus blue portion of the visible spectrum. The term "minus blue" is employed in its art recognized sense to encompass the green and red portions of the visible spectrum—i.e., from 500 to 700 nm. The term "specular light" is employed in its art recognized usage to indicate the type of spatially oriented light supplied by a camera lens to a film surface in its focal plane—i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (≦1500 nm). In most applications both the first and second emulsion layers record images within the visible spectrum. The second emulsion layer in most applications records blue or minus blue light and usually, but not necessarily, records light of a shorter wavelength than the first emulsion layer. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been discovered that a favorable combination of photographic sensitivity and image structure (e.g., granularity and sharpness) are realized when silver salt epitaxy sensitized ultrathin tabular grain emulsions satisfying the requirements of the invention are employed to format least the second, overlying emulsion layer. It is surprising that the presence of silver salt epitaxy on the ultrathin tabular grains of the overlying emulsion layer is consistent with observing sharp images in the first, underlying emulsion layer. Obtaining sharp images in the underlying emulsion layer is dependent on the ultrathin tabular grains in the overlying emulsion layer accounting for a high proportion of total grain projected area; however, grains having an ECD of less than 0.2 μm, if present, can be excluded in calculating total grain projected area, since these grains are relatively optically transparent. Excluding grains having an ECD of less than 0.2 μm in calculating total grain projected area, it is preferred that the overlying emulsion layer containing the silver salt epitaxy sensitized ultrathin tabular grain emulsion of the invention account for greater than 97 percent, preferably greater than 99 percent, of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying a minus blue recording emulsion layer to have a specific combination of grain properties. First, the tabular grains preferably contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm and an average grain thickness of less than 0.07 μm. The mean ECD of at least 0.7 μm is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the presence of silver salt epitaxy allows unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention. Photographic speeds are reported as relative log speeds, where a speed difference of 30 log units equals a speed difference of 0.3 log E, where E represents exposure in lux-seconds. Contrast is measured as mid-scale contrast. Halide ion concentrations are reported as mole percent (M %), based on silver.

Ultrathin Emulsion A

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ (2 $KHSO_5.KHSO_4.K_2SO_4$, purchased from Aldrich) in 20 cc of water, and the temperature was raised to 54° C. in 9 min. After the reactor and its contents were held at this temperature for 9 min, 100 g of oxidized methionine lime-processed bone gelatin dissolved in 1.5 L $H_2O$ at 54° C. were added to the reactor. Next the pH was raised to 5.90, and 122.5 cc of 1M NaBr were added to the reactor. Twenty four and a half minutes after nucleation the growth stage was begun during which 2.5 M $AgNO_3$, 2.8M NaBr, and a 0.148M suspension of AgI (Lippmann) were added in proportions to maintain (a) a uniform iodide level of 4.125M % in the growing silver halide crystals and (b) the reactor pBr at the value resulting from the cited NaBr additions prior to the start of nucleation and growth, until 0.848 mole of silver iodobromide had formed (53.33 min, constant flow rates), at which time the excess $Br^-$ concentration was increased by addition of 105 cc of 1M NaBr; the reactor pBr was maintained at the resulting value for the balance of the growth. The flow of the cited reactants was then resumed and the flow was accelerated such that the final flow rate at the end of the segment was approximately 12.6 times that at the beginning; a total of 9 moles of silver iodobromide (4.125M % I) was formed. When addition of $AgNO_3$, AgI and NaBr was complete, the resulting emulsion was coagulation washed and the pH and pBr were adjusted to storage values of 6 and 2.5, respectively.

The resulting emulsion was examined by scanning electron micrography (SEM). More than 99.5% of the total grain projected area was accounted for by tabular grains. The mean ECD of the emulsion grains was 1.89 μm, and their COV was 34. Since tabular grains accounted for very nearly all of the grains present, mean grain thickness was determined using a dye adsorption technique: The level of 1,1'-diethyl- 2,2'-cyanine dye required for saturation coverage was determined, and the equation for surface area was solved assuming the solution extinction coefficient of this dye to be 77,300 L/mole-cm and its site area per molecule to be 0.566 $nm^2$.

This approach gave a mean grain thickness value of 0.053 μm.

Thin Emulsion B

This emulsion was precipitated exactly as Emulsion A to the point at which 9 moles of silver iodobromide had been formed, then 6 moles of the silver iodobromide emulsion were taken from the reactor. Additional growth was carried out on the 3 moles which were retained in the reactor to serve as seed crystals for further thickness growth. Before initiating this additional growth, 17 grams of oxidized methionine lime-processed bone gelatin in 500 cc water at 54° C. was added, and the emulsion pBr was adjusted to ca. 3.3 by the slow addition of $AgNO_3$ alone until the pBr was about 2.2, followed by an unbalanced flow of $AgNO_3$ and NaBr. While maintaining this high pBr value and a temperature of 54° C., the seed crystals were grown by adding $AgNO_3$ and a mixed halide salt solution that was 95.875M % NaBr and 4.125M % KI until an additional 4.49 moles of silver iodobromide (4.125M % I) was formed; during this growth period, flow rates were accelerated 2× from start to finish. The resulting emulsion was coagulation washed and stored similarly as Emulsion A.

The resulting emulsion was examined similarly as Emulsion A. More than 99.5% of the total grain projected area was provided by tabular grains. The mean ECD of this emulsion was 1.76 μm, and their COV was 44. The mean thickness of the emulsion grains, determined from dye adsorption measurements like those described for Emulsion A, was 0.130 μm.

Sensitizations

Samples of the emulsions were next sensitized with and without silver salt epitaxy being present.

Epitaxial Sensitization Procedure

A 0.5 mole sample of the emulsion was melted at 40° C. and its pBr was adjusted to ca. 4 with a simultaneous addition of $AgNO_3$ and KI solutions in a ratio such that the small amount of silver halide precipitated during this adjustment was 12% I. Next, 2M % NaCl (based on the original amount of silver iodobromide host) was added, followed by addition of spectral sensitizers Dye 1 [anhydro-9-ethyl-5', 6'-dimethyoxy-5 -phenyl-3'-(3-sulfopropyl)-3-(3-sulfobutyl)oxathiacarbocyanine hydroxide] and Dye 2 [anhydro-5,5'-dichloro-9 -ethyl-3,3'-bis(3-sulfopropyl)thiacarbocyanine hydroxide, sodium salt], after which 6M % AgCl epitaxy was formed by a balanced double jet addition of $AgNO_3$ and NaCl solutions. This procedure produced epitaxial growths mainly on the corners and edges of the host tabular grains.

The epitaxially sensitized emulsion was split into smaller portions in order to determine optimal levels of subsequently added sensitizing components, and to test effects of level variations. The post-epitaxy components included additional portions of Dyes 1 and 2, 60 mg NaSCN/mole Ag, $Na_2S_2O_3.5\ H_2O$ (sulfur), $KAuCl_4$ (gold), and 11.44 mg 1-(3-acetamidophenyl)-5-mercaptotetrazole (APMT)/mole Ag. After all components were added the mixture was heated to 60° C. to complete the sensitization, and after cool-down, 114.4 mg additional APMT was added.

The resulting sensitized emulsions were coated on a cellulose acetate film support over a gray silver antihalation layer, and the emulsion layer was overcoated with a 4.3 $g/m^2$ gelatin layer containing surfactant and 1.75 percent by weight, based on total weight of gelatin, of bis(vinylsulfonyl)methane hardener. Emulsion laydown was 0.646 g $Ag/m^2$ and this layer also contained 0.323 $g/m^2$ and 0.019 $g/m^2$ of Couplers 1 and 2, respectively, 10.5 $mg/m^2$ of 4-hydroxy- 6-methyl-1,3,3a,7-tetraazaindene ($Na^+$ salt), and 14.4 $mg/m^2$ 2-(2-octadecyl)-5-sulfohydroquinone ($Na^+$ salt), surfactant and a total of 1.08 g gelatin/$m^2$. The emulsions so coated were given 0.01 sec Wratten 23A™ filtered (wavelengths>560 nm transmitted) daylight balanced light exposures through a calibrated neutral step tablet, and then were developed using the color negative Kodak Flexicolor™ C41 process. Speed was measured at a density of 0.15 above minimum density.

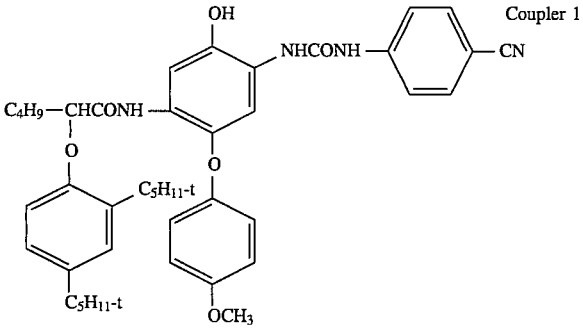

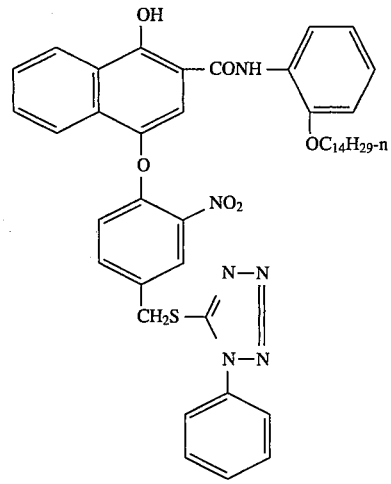

Nonepitaxial Sensitization Procedure

This sensitization procedure was similar to that described for epitaxial sensitizations, except that the epitaxial deposition step was omitted. Thus after adjusting the initial pBr to ca. 4, suitable amounts of Dye 1 and Dye 2 were added, then NaSCN, sulfur, gold and APMT were added as before, and this was followed by a heat cycle at 60° C.

Optimization

Beginning levels for spectral sensitizing dye, sulfur and gold sensitizers were those known to be approximately optimal from prior experience, based on mean grain ECD and thickness. Sensitization experiments were then conducted in which systematic variations were made in levels of dye, sulfur and gold. Reported below in Tables I and II are the highest speeds that were observed in sensitizing the thin and ultrathin tabular grain emulsions A and B, respectively. In Table III the contrasts are reported of the epitaxially sensitized thin and ultrathin tabular grain emulsions A and B reported in Tables I and II.

TABLE I

| Speed Increase Attributable to Epitaxy on Thin Host Tabular Grains | | | |
|---|---|---|---|
| Host Emulsion | Type of Sensitization | Dmin | Relative Log Speed |
| Emulsion B | Nonepitaxial | 0.11 | 100 |
| Emulsion B | Epitaxial | 0.15 | 130 |

TABLE II

| Speed Increase Attributable to Epitaxy on Ultrathin Tabular Grains | | | |
|---|---|---|---|
| Host Emulsion | Type of Sensitization | Dmin | Relative Log Speed |
| Emulsion A | Nonepitaxial | 0.14 | 100 |
| Emulsion A | Epitaxial | 0.15 | 150 |

TABLE III

| Contrast Comparisons of Epitaxially Sensitized Thin and Ultrathin Tabular Emulsions. | | | |
|---|---|---|---|
| Host Emulsion | Emulsion Type | Sensitization | Contrast |
| Emulsion B | Thin | Epitaxial | 0.68 |
| Emulsion A | Ultrathin | Epitaxial | 0.89 |

Tables I and II demonstrate that the speed gain resulting from epitaxial sensitization of an ultrathin tabular grain emulsion is markedly greater than that obtained by a comparable epitaxial sensitization of a thin tabular grain emulsion. Table III further demonstrates that the epitaxially sensitized ultrathin tabular grain emulsion further exhibits a higher contrast than the similarly sensitized thin tabular grain emulsion.

Specularity Comparisons

The procedure for determining the percent normalized specular transmittance of light through coatings of emulsions as outlined in Antoniades et al Example 6 was employed. Table IV summarizes data for the spectrally and epitaxially sensitized thin and ultrathin tabular emulsions described above in terms of percent normalized specular transmittance (% NST), with normalized specular transmittance being the ratio of the transmitted specular light to the total transmitted light. The percent transmittance and the percent normalized specular transmittance at either 550 nm or 650 nm were plotted versus silver laydown. The silver laydown corresponding to 70 percent total transmittance was determined from these plots and used to obtain the percent specular transmittance at both 550 and 650 nm.

TABLE IV

| Specularity Comparisons | | | | |
|---|---|---|---|---|
| Host | Sp. Sens. | M % AgCl | % NST | |
| Emulsion | Dyes | Epitaxy | 450 nm | 550 nm |
| thin Emulsion B | 1 & 2 | 6 | 20.7 | 18.6 |
| ultrathin Emulsion A | 1 & 2 | 6 | 70.7 | 71.6 |

From Table IV it is apparent that epitaxially sensitized ultrathin tabular grain emulsions exhibit a dramatic and surprising increase in percentage of total transmittance accounted for by specular transmittance as compared to thin tabular grain emulsions.

Spectrally Displaced Absorptions

The same coatings reported in Table IV that provided 70 percent total transmittance at 550 nm were additionally examined to determine their absorption at shorter wavelengths as compared to their absorption at the peak absorption wavelength provided by Dyes 1 and 2, which was 647 nm. The comparison of 600 nm absorption to 647 nm absorption is reported in Table V, but it was observed that absorptions at all off-peak wavelengths are lower with epitaxially sensitized ultrathin tabular grain emulsions than with similarly sensitized thin tabular grain emulsions.

TABLE V

| Relative Off-Peak Absorption | | | |
|---|---|---|---|
| Host Emulsion | Dyes | Mole % Epitaxy | Relative Absorption A600/A647 |
| thin Emulsion B | 1 & 2 | 6 | 0.476 |
| ultrathin Emulsion A | 1 & 2 | 6 | 0.370 |

From Table V it is apparent that the spectrally and epitaxially sensitized ultrathin tabular grain emulsion exhibited significantly less off-peak absorption than the compared similarly sensitized thin tabular grain emulsion.

Emulsion C

This emulsion was prepared in a manner similar to that described for Emulsion A, but with the precipitation procedure modified to provide a higher uniform iodide concentration ($AgBr_{0.88}I_{0.12}$) during growth and a smaller grain size.

Measuring grain parameters similarly as for Emulsion A, it was determined that in Emulsion C 99.4% of the total grain projected area was provided by tabular grains, the, mean grain ECD was 0.95 μm (COV=61), and the mean grain thickness was 0.049 μm.

Specularity as a Function of Epitaxial Levels

Formation of AgCl-epitaxy on the host ultrathin tabular grains of Emulsion C followed the general procedure described above for epitaxial sensitizations with flow rates typically such that 6 mole-% epitaxy formed per min, or higher. The emulsion samples were not sulfur or gold sensitized, since these sensitizations have no significant influence on specularity. In addition to spectral sensitizing Dye 2, the following alternative spectral sensitizing dyes were employed:

Dye 3: Anhydro-6,6'-dichloro-1,1'-diethyl-3,3'-bis(3-sulfopropyl)-5,5'-bis(trifluoromethyl)benzimidazole carbocyanine hydroxide, sodium salt;

Dye 4: Anhydro-5-chloro-9-ethyl-5'-phenyl-3'-(3 -sulfobutyl)-3-(3-sulfopropyl)oxacarbocyanine hydroxide, triethylammonium salt;

Dye 5: Anhydro-5,5'-dichloro-3,3'-bis(3-sulfopropyl)thiacyanine hydroxide, triethylammonium salt.

Since epitaxial deposition produces stoichiometric related amounts of sodium nitrate as a reaction by-product, which, if left in the emulsion when coated, could cause a haziness that could interfere with optical measurements, these epitaxially treated emulsions were all coagulation washed to remove such salts before they were coated.

TABLE VI

The Effect of Differing Levels of Epitaxy on the Specularity of Ultrathin Tabular Grain Emulsions

| Dye(s) | Mole % Epitaxy | % NST 450 nm | % NST 550 nm | % NST 650 nm |
|---|---|---|---|---|
| 2 | 0 | 71.4 | 68.4 | — |
| 2 | 12 | 65.7 | 67.0 | — |
| 2 | 24 | 65.7 | 61.4 | — |
| 2 | 36 | 64.0 | 64.3 | — |
| 2 | 100 | 50.7 | 52.9 | — |
| 3 & 4 | 0 | — | — | 59.3 |
| 3 & 4 | 12 | — | — | 57.1 |
| 5 | 0 | — | 62.9 | 60.9 |
| 5 | 12 | — | 57.6 | 57.7 |

Data in Table VI show that specularity observed for the host emulsion lacking epitaxy is decreased only slightly after epitaxy is deposited. Even more surprising is the high specularity that is observed with high levels of epitaxy. Note that specularity at 450 and 550 nm remains high as the level of epitaxy is increased from 0 to 100%. The percent normalized specular transmittance compares favorably with that reported by Antoniades et al in Table IV, even though Antoniades et al did not employ epitaxial sensitization. It is to be further noted that the acceptable levels of specular transmittance are achieved even when the level of epitaxy is either higher than preferred by Maskasky I or even higher than taught by Maskasky I to be useful.

Robustness Comparisons

To determine the robustness of the emulsions of the invention Emulsion A was sulfur and gold sensitized, with an without epitaxial sensitization, similarly as the emulsions reported in Table II, except that the procedure for optimizing sensitization was varied so that the effect of having slightly more or slightly less spectral sensitizing dye could be judged.

A preferred level of spectral sensitizing dye and sulfur and gold sensitizers was arrived at in the following manner: Beginning levels were selected based on prior experience with these and similar emulsions, so that observations began with near optimum sensitizations. Spectral sensitizing dye levels were varied from this condition to pick a workable optimum spectral sensitizing dye level, and sulfur and gold sensitization levels were then optimized for this dye level. The optimized sulfur ($Na_2S_2O_3.5H_2O$) and gold ($KAuCl_4$) levels were 5 and 1.39 mg/Ag mole, respectively.

With the optimized sulfur and gold sensitization selected, spectral sensitizing dye levels were varied to determine the degree to which differences in dye level affected emulsion sensitivity. The results are summarized in Table VII.

TABLE VII

Robustness Tests: Ultrathin Tabular Grain Emulsions Optimally Sulfur and Gold Sensitized Without Epitaxy

| Description | Dye 1 mM/Ag M | Dye 2 mM/Ag M | Rel. Speed | Dmin | Δ Speed |
|---|---|---|---|---|---|
| Mid Dye | 0.444 | 1.731 | 100 | 0.14 | check |
| High Dye | 0.469 | 1.827 | 117 | 0.14 | +17 |
| Low Dye | 0.419 | 1.629 | 84 | 0.15 | −16 |

For each one percent change in dye concentration speed varied 2.73 log speed units. When the speed variance was examined on a second occasion, a one percent concentration variance in spectral sensitizing dye resulted in a speed variation of 4.36 log speed units. The run to run variance merely served to reinforce the observed lack of robustness of the emulsions lacking epitaxy.

The experiments reported above were repeated, except that Emulsion A additionally received an epitaxial sensitization similarly as the epitaxially sensitized emulsion in Table II. The optimized sulfur ($Na_2S_2O_3$. $5H_2O$) and gold ($KAuCl_4$) levels were 2.83 and 0.99 mg/Ag mole, respectively. The results are summarized in Table VIII below:

TABLE VIII

Robustness Tests: Ultrathin Tabular Grain Emulsions Optimally Sulfur and Gold Sensitized With Epitaxy

| Description | Dye 1 mM/Ag M | Dye 2 mM/Ag M | Rel. Speed | Dmin | Δ Speed |
|---|---|---|---|---|---|
| Mid Dye | 0.444 | 1.73 | 100 | 0.14 | check |
| High Dye | 0.469 | 1.83 | 107 | 0.15 | +7 |
| Low Dye | 0.419 | 1.63 | 91 | 0.13 | −9 |

For each one percent change in dye concentration speed varied only 1.31 log speed units. This demonstrated a large and unexpected increase in the robustness of the epitaxially sensitized ultrathin tabular grain emulsion.

Iodide Profiles

This series of comparisons is provided for the purpose of demonstrating the speed-granularity relationship enhancements that are contributed by providing iodide profiles in the epitaxially sensitized ultrathin tabular grains that satisfy the requirements of the invention.

Emulsion D (uniform 1.5M % iodide)

A vessel equipped with a stirrer was charged with 6 L of water containing 3.75 g lime-processed bone gelatin that had not been treated with oxidizing agent to reduce its methionine content, 4.12 g NaBr, an antifoamant, and sufficient sulfuric acid to adjust pH to 1.8, at 39° C. During nucleation, which was accomplished by balanced simultaneous 4 sec. addition of $AgNO_3$ and halide (98.5 and 1.5 mole-% NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin was quickly oxidized by addition of 128 mg of Oxone™ ($2KHSO_5.KHSO_4.K_2SO_4$, purchased from Aldrich) in 20 cc $H_2O$, and the temperature was raised to 54° C. in 9 min. After the reactor and contents were held at this temperature for 9 min, 100 g of oxidized methionine lime-processed bone gelatin dissolved in 1.5 L $H_2O$ at 54° C. were added to the reactor. Next the pH was raised to 5.90, and 122.5 cc of 1M NaBr were added to the reactor. Twenty four and a half minutes after nucleation, the growth stage was begun during which 2.5M $AgNO_3$, 2.8M NaBr, and a 0.0524M suspension of AgI were added in proportions to maintain a uniform iodide level of 1.5 mole-% in the growing silver halide crystals, and the reactor pBr at the value resulting from the cited NaBr additions prior to start of nucleation and growth. This pBr was maintained until 0.825 mole of silver iodobromide had formed (constant flow rates for 40 min), at which time the excess $Br^-$ concentration was increased by addition of 105 cc of 1M NaBr, and the reactor pBr was maintained at the resulting value for the balance of grain growth. The flow rates of reactant introductions were accelerated approximately 12 fold during the remaining 64 min of grain growth. A total of 9 moles of silver iodobromide (1.5M % I) was formed. When addition of $AgNO_3$, AgI, and NaBr was complete, the resulting emulsion was coagulation washed, and pH and pBr were adjusted to storage values of 6 and 2.5, respectively.

The resulting emulsion was examined by SEM. Tabular grains accounted for greater than 99 percent of total grain projected area, the mean ECD of the emulsion grains was 1.98 μm (coefficient of variation=34). Employing the same measurement technique as for Emulsion A, mean tabular grain thickness was determined to be 0.055 μm.

Emulsion E (uniform 12M % iodide)

This emulsion was precipitated by the same procedure employed for Emulsion D, except that the flow rate ratio of AgI to $AgNO_3$ was increased so that a uniform 12M % iodide silver iodobromide grain composition resulted, and the flow rates of $AgNO_3$ and NaBr during growth were decreased such that the growth time was ca. 1.93 times as long, in order to avoid renucleation during growth of this less soluble, higher iodide emulsion.

Using the analysis techniques as employed for Emulsion D, Emulsion E was determined to consist of 98 percent by number tabular grains with tabular grains accounting for more than 99 percent of total grain projected area. The emulsion grains exhibited a mean ECD of 1.60 μm (COV=42) and a mean thickness of 0.086 μm. It was specifically noted that introducing 12 mole percent iodide throughout the precipitation had the effect of thickening the silver iodobromide tabular grains so that they no longer satisfied ultrathin tabular grain emulsion requirements.

Emulsion F (uniform 4.125M % iodide)

This emulsion was precipitated by the same procedure employed for Emulsion D, except that the flow rate ratio of AgI to $AgNO_3$ was increased so that a uniform 4.125M % iodide silver iodobromide composition resulted, and the flow rates of $AgNO_3$ and NaBr during growth were decreased such that the growth time was ca. 1.20 times as long, in order to avoid renucleation during growth of this less soluble, higher iodide emulsion.

Using the analysis techniques as employed for Emulsion D, Emulsion E was determined to consist of 97.8 percent by number tabular grains with tabular grains accounting for greater than 99 percent of total grain projected area. The emulsion grains exhibited a mean ECD of 1.89 μm (COV=34) and a mean thickness of 0.053 μm.

Emulsion G (profiled iodide)

This emulsion was precipitated by the same procedure employed for Emulsion D, except that after 6.75 moles of emulsion (amounting to 75 percent of total silver) had formed containing 1.5M % I silver iodobromide grains, the ratio of AgI to $AgNO_3$ additions was increased so that the remaining portion of the 9 mole batch was 12M % I. During formation of this higher iodide band, flow rate, based on rate of total Ag delivered to the reactor, was approximately 25% that employed in forming Emulsion D, (total growth time was 1.19 times as long) in order to avoid renucleation during formation of this less soluble, higher iodide composition.

Using the analysis techniques as employed for Emulsion D, Emulsion G was determined to consist of 97 percent by number tabular grains with tabular grains accounting for greater than 99 percent of total grain projected area. The emulsion grains exhibited a mean ECD of 1.67 μm (COV=39) and a mean thickness of 0.057 μm.

The composition and grain size data for Emulsions D through G are summarized below in Table IX.

TABLE IX

| Emulsion Grain Size and Halide Data | | | | |
|---|---|---|---|---|
| Emulsion | Iodide in AgIBr Grains | ECD (μm) | Thickness (μm) | Aspect Ratio |
| D | 1.5 M % I (uniform) | 1.98 | 0.055 | 36.0 |
| E | 12.0 M % I (uniform) | 1.60 | 0.086 | 18.6 |
| F | 4.125 M % I (uniform) | 1.89 | 0.053 | 35.7 |
| G | 1.5 M % I (1st 75% Ag) 12 M % I (last 25% Ag) | 1.67 | 0.056 | 29.8 |

Data in Table IX indicate that the emulsion satisfying the requirements of the invention, Emulsion G, contained grains dimensionally comparable to those of Emulsions D and F, containing uniformly distributed 1.5 or 4.125M % iodide concentrations, respectively. However, Emulsion E, which contained 12.0M % iodide uniformly distributed within the grains showed a loss in mean ECD, an increase in mean grain thickness, and a reduction in the average aspect ratio of the grains.

Sensitizations

Samples of the emulsions were next similarly sensitized to provide silver salt epitaxy selectively at corner sites on the tabular grains of Emulsions D, E, F and G.

In each case a 0.5 mole sample of host emulsion was melted at 40° C. and its pBr was adjusted to ca. 4 with a simultaneous addition of $AgNO_3$ and KI solutions in a ratio such that the small amount of silver halide precipitated during this adjustment was 12M % I. Next, 2M % NaCl (based on the amount of silver in the ultrathin tabular grain emulsion) was added, followed by addition of Dye 1 and Dye 2, after which 6M % AgCl epitaxy was formed by a balanced double jet addition of $AgNO_3$ and NaCl solutions. Epitaxial deposition was restricted to the corners of the tabular grains.

The epitaxially sensitized emulsion was split into smaller portions to determine optimal levels of subsequently added sensitizing components, and to test effects of level variations. The post-epitaxy components included additional portions of Dyes 1 and 2, 60 mg NaSCN/mole Ag, $Na_2S_2O_3.5H_2O$ (sulfur), $KAuCl_4$ (gold), and 11.44 mg APMT/mole Ag. After all components were added, the mixture was heated to 60° C. to complete the sensitization, and after cooling to 40° C., 114.4 mg additional APMT were added.

The resulting sensitized emulsions were coated on cellulose acetate support over a gray silver antihalation layer, and the emulsion layer was overcoated with a 4.3 g/m$^2$ gelatin layer. Emulsion laydown was 0.646 g Ag/m$^2$ and this layer also contained 0.323 g/m$^2$ and 0.019 g/m$^2$ of Couplers 1 and 2, respectively, 10.5 mg/m$^2$ of 4-hydroxy-6-methyl-1,3,3A, 7-tetraazaindene ($Na^+$ salt), and 14.4 mg/m$^2$ 2-(2-octadecyl)-5-sulfohydroquinone ($Na^+$ salt), and a total of 1.08 g gelatin/m$^2$. The-emulsion layer was overcoated with a 4.3 g/m$^2$ gelatin layer containing surfactant and 1.75 percent by weight, based on the total weight of gelatin, of bis(vinylsulfonyl)methane hardener.

The emulsions so coated were given 0.01" Wratten 23A™ filtered daylight balanced light exposures through a 21 step granularity step tablet (0–3 density range), and then were developed using the Kodak Flexicolor™ C41 color negative process. Speed was measured at a density of 0.30 above $D_{min}$.

Granularity readings on the same processed strips were made according to procedures described in the SPSE Handbook of Photographic Science and Engineering, edited by W. Thomas, pp. 934–939. Granularity readings at each step were divided by the contrast at the same step, and the minimum contrast normalized granularity reading was recorded. Contrast normalized granularity is reported in grain units (g.u.), in which each g.u. represents a 5% change; positive and negative changes corresponding to grainier and less grainy images, respectively (i.e., negative changes are desirable). Contrast-normalized granularities were chosen for comparison to eliminate granularity differences attributable to contrast differences. Since the random dot model for granularity predicts that granularity is inversely proportional to the square root of the number of imaging centers (M. A. Kriss in The Theory of the Photographic Process, 4th Ed. T. H. James, ed., New York, Macmillan, 1977; p. 625), and larger grains generally are needed to achieve higher speeds, it is generally accepted that in emulsions granularity will increase at a rate of ca. 7 g.u. for each gain of 30 log speed units at constant Ag laydown and photoefficiency.

Optimizations of the sensitizations of each of the emulsions was completed as described for Emulsions A and B. Relative log speed and minimum contrast-normalized granularity for optimized sensitizations are reported in Table X.

TABLE X

Speed and Contrast Normalized Granularity Responses

| Emulsion | Δ Speed | Relative Granularity | Contrast |
|---|---|---|---|
| D | Check | Check | 0.85 |
| E | +9 | +4.5 | 0.55 |
| F | +11 | −3.0 | 0.91 |
| G | +21 | −7.6 | 0.94 |

The data in Table X clearly demonstrate the advantage that the higher iodide laterally displaced region grain structure offers as compared to the three comparison (uniform iodide ultrathin tabular grain) emulsions when all are given corner epitaxial sensitizations. The emulsion satisfying the requirements of the invention, Emulsion G, exhibited both the highest photographic speed and contrast and the lowest image granularity and hence was clearly photographically superior to the compared emulsions of similar structure, but lacking the required iodide profile.

Laterally Displaced Region vs. Central Region Epitaxy

Emulsion H (Profiled iodide, AgBr Central Region)

This emulsion was precipitated similarly as Emulsions D–G, but with the significant difference of lowered iodide concentrations in the central regions of the ultrathin tabular grains. The absence of iodide in the central region was of key importance, since, in the absence of an adsorbed site director, the portions of the major faces of the ultrathin tabular grains formed by the central region accepts silver salt epitaxy. Therefore this structure was chosen to allow comparison of central region and laterally displaced region (specifically, corner) epitaxial sensitizations, which can be formed in the absence or presence, respectively, of one or more adsorbed site directors. In addition to the noted change in halide composition, other modifications of the precipitation procedure described above for Emulsions D through G include use of NaOCl rather than Oxone™ for in situ oxidation of nucleation gelatin, increased batch size (12 rather than 9 moles), and use of a parabolic flow rate acceleration during early growth.

The first 75 percent of the silver was precipitated in the absence of iodide while the final 25 percent of the silver was precipitated in the presence of 6M % I.

Using analysis techniques described above, Emulsion H was found to consist of 98 percent tabular grains, which accounted for greater than 99 percent of total grain projected area. The emulsion exhibited a mean ECD of 2.19 μm ECD (COV= 54) and a mean grain thickness 0.056 μm.

Emulsion H/CR (Central Region Epitaxial Sensitization)

The procedure used to form epitaxy on the portions of the major faces of the ultrathin tabular grains of Emulsion H formed by the central regions was like that described above for the corner epitaxial sensitization of Emulsions D through G, but with these differences: 1) The initial pBr adjustment prior to formation of epitaxy was with $AgNO_3$ alone rather than with a simultaneous addition of $AgNO_3$ and KI. 2) The pBr was adjusted to ca. 3.5 rather than 4. 3) There were no dye additions prior to formation of epitaxy. (These differences were undertaken to eliminate corner site direction for the epitaxy.) 4) The level of AgCl epitaxy, based on the Emulsion G silver prior to epitaxial deposition was 12 rather than 6M %.

Scanning electron micrographic examination indicated that the epitaxy was deposited predominantly on the major faces of the ultrathin tabular grains.

In an effort to obtain optimum photographic performance the resulting emulsion with facial epitaxy was subjected to level variations in spectral sensitizing dye, $Na_2S_2O_3.5H_2O$, and $KAuCl_4$. Within the design space examined optimum performance was found with these levels (in mg/mole Ag): 250 Dye 1, 1025 Dye 2, 60 NaSCN, 3.13 $Na_2S_2O_3.5H_2O$, 1.10 $KAuCl_4$, 11.44 mg APMT. After adding these compounds, the resulting mixture was heated to facilitate sensitization, after which 114.4 mg APMT were added as a stabilizer. Coating format, exposure and processing were as described above for Emulsions D through G.

Speed-granularity relationships are summarized for comparison in Table XI below.

Emulsion H/LDR (Laterally Displaced Region Epitaxial Sensitization)

The general procedure for formation of corner epitaxy was the same as described above for Emulsions D through G, except that, like Emulsion H/CR, 12 rather than 6 mole-% AgCl epitaxy was formed, and dye, sulfur, and gold levels were varied as a means toward seeking optimum photographic performance of this emulsion. Within the design space examined, optimum responses were observed for these levels in mg/mole Ag: 250 of Dye 1 and 1025 Dye 2 prior to the formation of epitaxy, and 25 mg and 102.5 mg, respectively, after formation of epitaxy, 3.13 mg $Na_2S_2O_3.5H_2O$, and 0.9 mg $KAuCl_4$.

The resulting corner epitaxially sensitized emulsion was coated, exposed, and processed identically as Emulsion H/CR.

Speed-granularity relationships are summarized for comparison in Table XI below.

TABLE XI

Speed and Contrast Normalized Granularity Responses

| Emulsion | Location of Epitaxy | Δ Speed | Relative Granularity |
|---|---|---|---|
| H/CR | Major Faces | Check | Check |
| H/LDR | Corners | +51 | +3 |

Data in Table XI demonstrate the substantial advantage of corner epitaxial sensitizations compared to those involving epitaxy distributed over the major faces of the tabular grains. Emulsion H/CR is 51 speed units faster than Emulsion H/LDR, with only a 3 g.u. penalty. This is a highly favorable speed/granularity trade; from previous discussion it is evident that the random dot model predicts ca. 11.9 g.u. increase as a penalty accompanying the 0.51 log E speed increase at constant Ag laydown, assuming an invariant photoefficiency. Thus corner epitaxy sensitization of the profiled iodide ultrathin tabular grain emulsions of the invention offers a large speed-granularity (photoefficiency) advantage over the same profiled iodide ultrathin tabular gain emulsions, but with the silver salt epitaxy distributed over the major faces of the grains. Hence, the improved photoefficiency of the emulsions of the invention is not only a function of the iodide profiling selected, but also a function of the silver salt epitaxy and its location.

Increased Iodide in Epitaxy Varied Iodide Sensitizations of Emulsion C

To demonstrate the relationship between silver and halide ions introduced during epitaxial sensitization and the levels of iodide found in the silver halide protrusions formed, a series of sensitizations were undertaken. In each case 0.25 mole of Emulsion C was dyed with 1715 mg of Dye 2 per Ag mole, then emulsion pBr was adjusted to 4.0 with $AgNO_3$ and KI added in relative rates so that the small amount of silver halide formed corresponded to the original composition $AgI_{0.12}Br_{0.88}$.

Silver halide epitaxy amounting to 12 mole percent of silver contained in the host tabular grains was then precipitated. Halide and silver salt solutions were added in sequence with a two mole percent excess of the chloride salt being maintained to assure precipitation of AgCl. Silver and halide additions are reported below based on mole percentages of silver in the host tabular grains. The rate of $AgNO_3$ addition was regulated to precipitate epitaxy at the rate of 6 mole percent per minute.

Sensitization C-1: 14M % NaCl was added followed by 12M % $AgNO_3$ for a nominal (input) epitaxy composition of 12M % AgCl.

Sensitization C-2: 12.08M % NaCl was added followed by 1.92M % AgI (Lippmann) followed in turn by 10.08M % $AgNO_3$ for a nominal (input) epitaxy composition of 12M % $AgI_{0.16}Cl_{0.84}$.

Sensitization C-3: 7.04M % NaCl was added followed by 5.04M % NaBr followed in turn by 1.92M % AgI (Lippmann) followed in turn by 10.08M % $AgNO_3$ for a nominal composition of 12M % $AgI_{0.16}Br_{0.42}Cl_{0.42}$.

Following the epitaxial depositions, the separately sensitized samples were subjected to chemical sensitization finishing conditions, but sulfur and gold sensitizers were withheld to avoid complicating halide analysis of the epitaxial protrusions. Finishing consisted of adding 60 mg of NaSCN and 11.4 mg of APMT per Ag mole. These additions were followed by heating the mixture to 50° C., followed by the addition of 114.4 mg of APMT per silver mole.

Analytical electron microscopy (AEM) techniques were then employed to determine the actual as opposed to nominal (input) compositions of the silver halide epitaxial protrusions. The general procedure for AEM is described by J. I. Goldstein and D. B. Williams, "X-ray Analysis in the TEM/STEM", Scanning Electron Microscopy/1977; Vol. 1, IIT Research Institute, March 1977, p. 651. The composition of an individual epitaxial protrusion was determined by focusing an electron beam to a size small enough to irradiate only the protrusion being examined. The selective location of the epitaxial protrusions at the corners of the host tabular grains facilitated addressing only the epitaxial protrusions. Each corner epitaxial protrusion on each of 25 grains was examined for each of the sensitizations. The results are summarized in Table XII.

TABLE XII

| | Halide in Epitaxy | | | |
|---|---|---|---|---|
| | Halide | Halide Found | | |
| Sample | Added | Cl | Br | I |
| C-1 | Cl 100% I 16% | 72.6% | 26.8% | 0.6% |
| C-2 | Cl 84% I 16% | 69.4% | 28.7% | 1.9% |
| C-3 | Br/Cl 42% | 28.4% | 64.5% | 7.2% |

The minimum AEM detection limit was a halide concentration of 0.5M %.

From Table XII, referring to C-1, it is apparent that, even when chloride was the sole halide added to the silver iodobromide ultrathin tabular grain emulsion during precipitation of the epitaxial protrusions, migration of iodide ion from the host emulsion into the epitaxy was low, less than 1 mole percent, but bromide ion inclusion was higher, probably due to the greater solubility of AgBr in AgCl compared to the solubility of AgI in AgCl.

Referring to C-2, when iodide was added along with chloride during epitaxial deposition, the iodide concentration was increased above 1.5M % while bromide inclusion in the epitaxy remained relatively constant.

Referring to C-3, when half of the chloride added in C-2 was replaced by bromide, the iodide concentration was dramatically increased as compared to C-2, even though the same amount of iodide was added in each sensitization.

Nominal AgCl vs. Nominal AgICl Epitaxy

Emulsion I

The emulsion prepared was a silver iodobromide emulsion containing 4.125M % I, based on total silver. A central region of the grains accounting for 75% of total silver containing 1.5M % I while a laterally displaced region accounting for the last 25 % of total silver precipitated contained 12M % I.

A vessel equipped with a stirrer was charged with 9.375 L of water containing 30.0 grams of phthalic anhydride-treated gelatin (10% by weight) 3.60 g NaBr, an antifoamant, and sufficient sulfuric acid to adjust pH to 2.0 at 60° C. During nucleation, which was accomplished by an unbalanced simultaneous 30 sec. addition of $AgNO_3$ and halide (0.090 mole $AgNO_3$, 0.1095 mole NaBr, and 0.0081 mole KI) solutions, during which time reactor pBr decreased due to excess NaBr that was added during nucleation, and pH remained approximately constant relative to values initially set in the reactor solution. Following nucleation, the reactor gelatin was quickly oxidized by addition of 1021 mg of Oxone™ ($2KHSO_5.KHSO_4.K_2SO_4$, purchased from Aldrich) in 50 cc $H_2O$. After the reactor and contents were held at this temperature for 7 min, 100 g of oxidized methionine lime-processed bone gelatin dissolved in 1.5 L $H_2O$ at 54° C. was added to the reactor. Next the pH was raised to 5.90, and 12 min after completing nucleation, 196.0 cc of 1M NaBr were added to the reactor. Fourteen minutes after nucleation was completed the growth stage was begun during which 2.30M $AgNO_3$ and 2.49M NaBr solutions, and a 0.04624M suspension of AgI (Lippmann) were added in proportions to maintain a uniform iodide level of 1.5M % in the growing silver halide crystals. The reactor pBr resulted from the cited NaBr additions prior to start of and during nucleation and prior to growth. This pBr was maintained until 2.775 moles of silver iodobromide had formed (flow rate accelerated to a value 1.87 times that at the start of this segment over 26.2 min) at which time flow of the cited AgI suspension was stopped and addition of a more concentrated AgI suspension (0.4140M) was begun, and the rate of addition of $AgNO_3$ was decreased by ca. 56% as growth of this 12M % iodide portion was begun. During this final growth stage, which lasted 12.5 min, $AgNO_3$ flow rate acceleration (end flow was 1.52 times that of that at the beginning of this segment) was resumed and flow of the NaBr solution and the AgI suspension were regulated so that reactor pBr was maintained as set by NaBr additions before and during nucleation and prior to start of growth, and so that a $AgI_{0.12}Br_{0.88}$ composition was achieved. A total of 3.7 moles of silver iodobromide were formed. When additions of $AgNO_3$, AgI, and NaBr were complete, the resulting emulsion was coagulation washed, and pH and pBr were adjusted to storage values of 6 and 3.0, respectively.

The resulting emulsion was examined by SEM. Greater than 99 percent of total grain projected area was accounted for by tabular grains. The mean ECD of the emulsion grains was 0.57 μm (COV)= 54). Since this emulsion is almost exclusively tabular, the grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole-cm and its site area per molecule to be 0.566 $nm^2$.

This approach gave a mean grain thickness value of 0.043 μm.

Sensitization I-1 Nominal AgCl

The following procedure was used for epitaxy formation and sensitization and for evaluation of photographic responses: In each case a 0.5 mole sample of Emulsion I was melted at 40° C. and its pBr was adjusted to ca. 4 by simultaneous addition of $AgNO_3$ and KI solutions in a ratio such that the small amount of silver halide precipitated during this adjustment was 12M % I. Next, 2M % NaCl (based on the original amount of Emulsion I) was added, followed by addition of 1696 mg Dye 4 and 152.7 mg Dye 6 [anhydro-3,9 -diethyl-3'-(N-sulfomethylcarbamoylmethyl)oxathiacarbocyanine hydroxide] per mole Ag, after which 6M % AgCl epitaxy was formed by a balanced double jet addition of $AgNO_3$ and NaCl solutions (1 min addition time). The post-epitaxy components (cited levels are per mole total Ag) included 0.14 mg bis(2-amino-5-iodopyridinedihydroiodide) mercuric iodide, 137 mg Dye 4, 12.4 mg Dye 6, 60 mg NaSCN, 6.4 mg Sensitizer 1 (sulfur), 3 mg Sensitizer 2 (gold), and 11.4 mg APMT.

Sensitizer 1

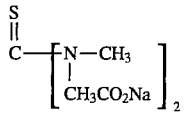

Sensitizer 2

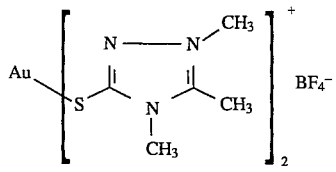

After all components were added, the mixture was heated to 50° C. for 5 min to complete the sensitization, and after cooling to 40° C., 114.35 mg additional APMT were added. The coating support was a 132 μm thick cellulose acetate film support that had a rem jet antihalation backing and a gelatin subbing layer (4.89 $g/m^2$), and the emulsion layer was overcoated with a 4.3 $g/m^2$ gelatin layer which also contained surfactant and 1.75 percent by weight, based on total gelatin, of bis(vinylsulfonyl)methane hardener. Emulsion laydown was 0.538 g $Ag/m^2$ and this layer also contained 0.398 $g/m^2$ and 0.022 $g/m^2$ of Couplers 3 and 4, respectively, 8.72 $mg/m^2$ of 4-hydroxy-6-methyl-1,3,3a,7-tetraazaindene ($Na^+$ salt), and 11.96 $mg/m^2$ 2-(2-octadecyl)-5 -sulfohydroquinone ($Na^+$ salt), surfactant and a total of 1.08 g gelatin/$m^2$.

Coupler 3

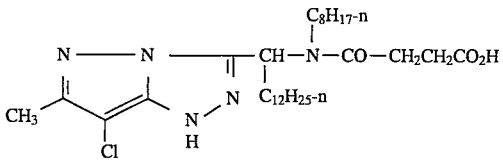

-continued

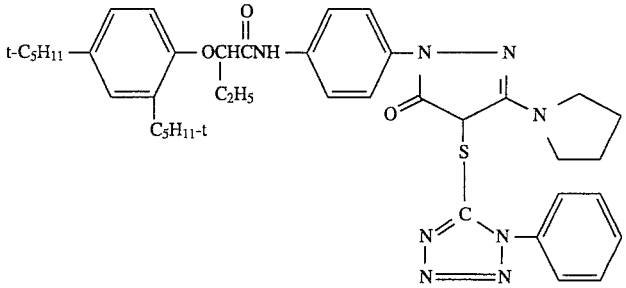

Coupler 4

The emulsions so coated were given 0.01" Wratten 9™ filtered (>460 nm) daylight balanced light exposures through a 21 step granularity step tablet (0–3 density range), and then were developed using the Kodak Flexicolor™ C41 color negative process. Speed was measured at 0.15 above minimum density. Granularity readings on the same processed strips were made as described for Emulsions D through G.

Sensitization I-2 Nominal AgICl

The sensitization, coating and evaluation procedures were the same as for Sensitization D-1, except that the halide salt solution for double jet formation of epitaxy was 92M % Cl added as NaCl and 8 M % I added as KI.

The performance comparisons of Sensitizations I-1 and I-2 are reported in Table XIII.

TABLE XIII

Performance Comparisons of Varied Iodide in Epitaxy

| Nominal Epitaxy Halide | $D_{min}$ | Speed | Contrast | Contrast Normalized Granularity* |
|---|---|---|---|---|
| Cl | 0.10 | 198 | 1.15 | Check |
| Cl 0.92<br>I 0.08 | 0.08 | 196 | 1.39 | −3.1 g.u. |

*Average of readings over 4 exposure steps near minimum granularity

Emulsion J

The emulsion prepared was a silver iodobromide emulsion containing 4.125M % I, based on total silver. A central region of the grains accounting for 75% of total silver contained 1.5M % I while a laterally displaced region accounting for the last 25 % of total silver precipitated contained 12M % I.

A vessel equipped with a stirrer was charged with 6 L of water containing 3.75 g lime-processed bone gelatin, 4.12 g NaBr, an antifoamant, and sufficient sulfuric acid to adjust pH to 1.86, at 39° C. During nucleation, which was accomplished by balanced simultaneous 4 sec. addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the reactor gelatin methionine was quickly oxidized by addition of 128 mg of Oxone™ ($2KHSO_5.KHSO_4.K_2SO_4$, purchased from Aldrich) in 50 cc $H_2O$, and the temperature was raised to 54° C. in 9 min. After the reactor and contents were held at this temperature for 9 min, 100 g of oxidized methionine lime-processed bone gelatin dissolved in 0.5 L $H_2O$ at 54° C. were added to the reactor. Next the pH was raised to 5.87, and 107.0 cc of 1M NaBr were added to the reactor. Twenty two minutes after nucleation was started, the growth stage was begun during which 1.6M $AgNO_3$, 1.75M NaBr and a 0.0222M suspension of AgI (Lippmann) were added in proportions to maintain a uniform iodide level of 1.5M % in the growing silver halide crystals, and the reactor pBr at the value resulting from the cited NaBr additions prior to start of nucleation and growth. This pBr was maintained until 0.825 mole of silver iodobromide had formed (constant flow rates for 40 min), at which time the excess $Br^-$ concentration was increased by addition of 75 cc of 1.75M NaBr, the reactor pBr being maintained at the resulting value for the balance of the growth. The flow rate of $AgNO_3$ was accelerated to approximately 8.0 times its starting value during the next 41.3 min of growth. After 4.50 moles of emulsion had formed (1.5M % I), the ratio of flows of AgI to $AgNO_3$ was changed such that the remaining portion of the 6 mole batch was 12M % I. At the start of the formation of this high iodide band, the flow rate, based on rate of total Ag delivered to the reactors was initially decreased to approximately 25% of the value at the end of the preceding segment in order to avoid renucleation during formation of this less soluble, higher iodide band, but the flow rate was doubled from start to finish of the portion of the run. When addition of $AgNO_3$, AgI and NaBr was complete, the resulting emulsion was coagulation washed and pH and pBr were adjusted to storage values of 6 and 2.5, respectively.

Particle size and thickness were determined by methods described for Emulsion H. Mean grain ECD was 1.30 μm (COV= 47), and thickness was 0.052 μm. Tabular grains accounted for >99% of total grain projected area.

Sensitization J-1 Nominal AgCl

A 0.5 mole sample of Emulsion J was melted at 40° C., and its pBr was adjusted to ca. 4 by simultaneous addition of $AgNO_3$ and KI solutions in a ratio such that the small amount of silver halide precipitated during this adjustment was 12M % I. Next, 2M % NaCl (based on silver in Emulsion J) was added, followed by addition of 1170 mg Dye 4 and 117.9 mg Dye 6 and 119 mg of Dye 7 [anhydro-9-ethyl-5,6-dimethoxy-5'-phenyl-3,3'-bis(sulfopropyl)oxacarbocyanine hydroxide, sodium salt] per mole Ag, after which 6M % AgCl epitaxy was formed by a balanced double jet addition of $AgNO_3$ and NaCl solutions (1 min addition time). After formation of epitaxy, the resulting emulsion was chill-set and then 0.04 mole portions of it were taken for remaining steps in the sensitization. This allowed variations in levels of sensitizers in order to determine optimum treatment combinations. The post-epitaxy components (cited levels are per mole Ag) included Dye 4, Dye 6 and Dye 7, 60 mg NaSCN/mole Ag, Sensitizer 1 (sulfur), Sensitizer 2 (gold), and 8.0 mg N-methylbenzothiazolium iodide. After all components were added, the mixture was heated to 50° C. for 5 min to complete the sensitization, and after cooling to 40° C., 114.35 mg additional APMT was added.

Coating, exposure, processing and evaluation was as described above for the sensitizations of Emulsion H. Within the design space explored, the optimum speed/$D_{min}$ ($D_{min}$= 0.10 or less) response was observed for these post sensitization additions (levels in mg/mole Ag): 243 mg Dye 4, 12.15 mg Dye 6, 12.2 mg Dye 7, 2.68 mg Sensitizer 1, and 1.35 mg Sensitizer 2.

Sensitization J-2 Nominal AgICl

The procedure was identical to Sensitization J-1, except that the halide salt solution used to form epitaxy was 84M % NaCl and 16M % KI—i.e., optimum photographic responses were observed at the same sensitizer levels as for the nominal AgCl epitaxial sensitization of Sensitization E-2.

The performance comparisons of Sensitizations J-1 and J-2 are reported in Table XIV.

TABLE XIV

Performance Comparisons of Varied Iodide in Epitaxy

| Nominal Epitaxy Halide | $D_{min}$ | Speed | Contrast | Contrast Normalized Granularity* |
|---|---|---|---|---|
| Cl | 0.10 | 240 | 1.42 | Check |
| Cl 0.84<br>I 0.16 | 0.08 | 241 | 1.58 | −2.8 g.u. |

*Average of readings over 4 exposure steps near minimum granularity

From a comparison of Tables XIII and XIV it is apparent that the increased iodide in the silver halide epitaxy increased contrast and decreased granularity, and the further increase in iodide in Table XIV as compared to Table XIII further increased contrast.

Emulsion K

The emulsion prepared was a silver iodobromide emulsion containing 4.125M % I, based on total silver. A central region of the grains accounting for 74% of total silver contained 1.5M % I while a laterally displaced region accounting for the last 26% of total silver precipitated contained 12M % I.

A vessel equipped with a stirrer was charged with 6 L of water containing 3.75 g lime-processed bone gelatin, 4.12 g NaBr, an antifoamant, and sufficient sulfuric acid to adjust pH to 5.41, at 39° C. During nucleation, which was accomplished by balanced simultaneous 4 sec. addition of $AgNO_3$ and halide (98.5 and 1.5M % NaBr and KI, respectively) solutions, both at 2.5M, in sufficient quantity to form 0.01335 mole of silver iodobromide, pBr and pH remained approximately at the values initially set in the reactor solution. Following nucleation, the methionine in the reactor gelatin was quickly oxidized by addition of 0.656 cc of a solution that was 4.74M % NaOCl, and the temperature was raised to 54° C. in 9 min. After the reactor and contents were held at this temperature for 9 min, 100 g of oxidized methionine lime-processed bone gelatin dissolved in 1.5 L $H_2O$ at 54° C., and 122.5 cc of 1M NaBr were added to it (after which pH was ca. 5.74). Twenty four and a half minutes after nucleation, the growth stage was begun during which 2.50M $AgNO_3$, 2.80 M NaBr, and a 0.0397M suspension of AgI (Lippmann) were added in proportions to maintain a uniform iodide level of 1.5M % in the growing silver halide crystals, and the reactor pBr at the value resulting from the cited NaBr additions prior to the start of nucleation and growth. This pBr was maintained until 0.825 mole of silver iodobromide had formed (constant flow rates for 40 min), at which time the excess $Br^-$ concentration was increased by addition of 105 cc of 1M NaBr, the reactor pBr being maintained at the resulting value for the balance of the growth. The flow rate of $AgNO_3$ was accelerated to approximately 10 times the starting value in this segment during the next 52.5 min of growth. After 6.69 moles of emulsion had formed (1.5M % I), the ratio of flow of AgI to $AgNO_3$ was changed such that the remaining portion of the 9 mole batch was 12M % I. At the start of the formation of this high iodide band, growth reactant flow rate, based on rate of total Ag delivered to the reactor, was initially decreased to approximately 25% of the value at the end of the preceding segment in order to avoid renucleation during formation of this less soluble, higher iodide composition band, but it was accelerated (end flow 1.6 times that at the start of this segment) during formation of this part of the emulsion. When addition of $AgNO_3$, AgI and NaBr was complete, the resulting emulsion was coagulation washed and pH and pBr were adjusted to storage values of 6 and 2.5, respectively.

Particle size and thickness were determined by methods described for Emulsion H. Mean grain ECD was 1.50 μm (COV= 53), and thickness was 0.060 μm. Tabular grains accounted for >99% of total grain projected area.

Sensitization K-1 Nominal AgCl

A 0.5 mole sample of Emulsion K was melted at 40° C. and its pBr was adjusted to ca. 4 by simultaneous addition of $AgNO_3$ and KI solutions in a ratio such that the small amount of silver halide precipitated during this adjustment was 12M % I. Next, 2M % NaCl (based on the original amount of silver in the Emulsion F sample) was added, followed by addition of Dye 4 and Dye 6 (1173 and 106 mg/mole Ag, respectively), after which 6 mole-% epitaxy was formed as follows: A single-jet addition of 6M % NaCl, based on the original amount of host emulsion, was made, and this was followed by a single-jet addition of 6M % $AgNO_3$. The $AgNO_3$ addition was made in 1 min. The post-epitaxy components added were 60 mg NaSCN/mole Ag, $Na_2S_2O_3.5H_2O$ (sulfur sensitizer) and $KAuCl_4$ (gold sensitizer), and 3.99 mg 3-methyl-1,3-benzothiazolium iodide/mole Ag. Sulfur and gold sensitizer levels were the best obtained from several trial sensitizations. After all components were added, the mixture was heated to 60° C. for 8 min to complete the sensitization. After cooling to 40° C., 114.35 mg APMT/mole Ag were added. The optimum sensitization was 2.9 mg/M Ag $Na_2S_2O_3.5H_2O$ and 1.10 mg/M Ag $KAuCl_4$.

Coating, exposure, processing and evaluation were conducted similar as described for Emulsion H, except that Coupler 5 (0.323 g/m$^2$) was substituted for Coupler 3, and the laydown of Coupler 2 was 0.016 g/m$^2$.

Coupler 5

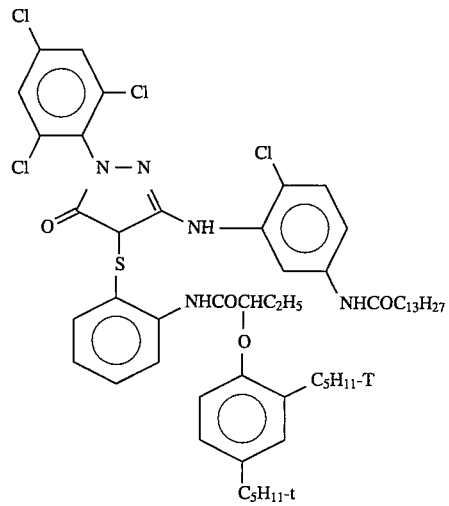

Sensitization K-2 Nominal AgIBrCl

The procedure was identical to Sensitization K-1, except that instead of the sequential single jet additions of 6M % NaCl and 6M % $AgNO_3$ the following were added sequentially: 2.52M % NaCl, 2.52M % NaBr, 0.96M % AgI (Lippmann) and 5.04M % $AgNO_3$. The percentages are based on silver provided by Emulsion K. The optimum sensitization was 2.3 mg/M Ag $Na_2S_2O_3.5H_2O$ and 0.80 mg/M Ag $KAuCl_4$.

The performance comparisons of Sensitizations K-1 and K-2 are reported in Table XV.

TABLE XV

Performance Comparisons of Varied Iodide in Epitaxy

| Nominal Epitaxy Halide | $D_{min}$ | Speed | Contrast | Contrast Normalized Granularity* |
|---|---|---|---|---|
| Cl | 0.09 | 100 | 0.51 | Check |
| Cl 0.42<br>Br 0.42<br>I 0.16 | 0.08 | 106 | 0.56 | −3.5 g.u. |

*Average of readings over 4 exposure steps near minimum granularity

From Table XV it is apparent that the increased bromide and iodide in the silver halide epitaxy increased contrast and decreased granularity.

Dopant Observations

Shallow Electron Trap Dopants in Ultrathin Tabular Grains

Emulsion L (no dopant)

A silver iodobromide (2.6M % I, uniformly distributed) emulsion was precipitated by a procedure similar to that employed by Antoniades et al for precipitation of Emulsions TE-4 to TE-11. Greater than 99 percent of total grain projected area was accounted for by tabular grains. The mean ECD of the grains was 2.45 μm and the mean thickness of the grains was 0.051 μm. The average aspect ratio of the grains was 48. No dopant was introduced during the precipitation of this emulsion.

Emulsions M through W

A series of emulsions were prepared similarly as Emulsion L, except that $K_4Ru(CN)_6$ (SET-2) was incorporated as a dopant in the ultrathin tabular grains following nucleation over an extended interval of grain growth to minimize thickening of the tabular grains. Attempts to introduce the dopant into the reaction vessel prior to nucleation resulted in thickening of the ultrathin tabular grains and, at higher dopant concentrations, formation of tabular grains which were greater than 0.07 μm in thickness. All of the emulsions, except Emulsion O, contained the same iodide content and profile as Emulsion L. Emulsion O was precipitated by introducing no iodide in the interval from 0.2 to 55 percent of silver addition and by introducing iodide at a 2.6M % concentration for the remainder of the precipitation.

The results are summarized in Table XVI. The concentrations of the dopants are reported in terms of molar parts of dopant added per million molar parts of Ag (mppm). The Profile % refers to the interval of dopant introduction, referenced to the percent of total silver present in the reaction vessel at the start and finish of dopant introduction.

TABLE XVI

| Emul. | Total Dopant mppm | Local Dopant Conc. mppm | Dopant Profile % | Grain Thickness μm | Av. Aspect Ratio |
|---|---|---|---|---|---|
| M | 50 | 63 | 0.2–80 | 0.050 | 48 |
| N | 110 | 138 | 0.2–80 | 0.051 | 48 |
| O | 110 | 275 | 0.2–40 | 0.049 | 44 |
| P | 110 | 275 | 0.2–40 | 0.050 | 46 |
| Q | 110 | 275 | 40–80 | 0.051 | 48 |
| R | 110 | 275 | 60–100 | 0.049 | 51 |
| S | 110 | 550 | 60–80 | 0.049 | 49 |
| T | 220 | 275 | 0.2–80 | 0.050 | 45 |

TABLE XVI-continued

| Emul. | Total Dopant mppm | Local Dopant Conc. mppm | Dopant Profile % | Grain Thickness μm | Av. Aspect Ratio |
|---|---|---|---|---|---|
| U | 220 | 1100 | 60–80 | 0.050 | 50 |
| V | 440 | 550 | 0.2–80 | 0.052 | 45 |
| W | 880 | 1100 | 0.2–80 | 0.053 | 49 |

Sensitizations and Evaluations

Emulsions L through W were identically chemically and spectrally sensitized as follows: 150 mg/Ag mole NaSCN, 2.1 mmole/Ag mole of Dye 2, 20 μmole/Ag mole Sensitizer 1 and 6.7 μmole Sensitizer 2 were added to the emulsion. The emulsion was then subjected to a heat digestion at 65° C. for 15 minutes, followed by that addition of 0.45M % KI and $AgNO_3$.

Samples of the sensitized emulsions were then coated as follows: 0.538 g Ag/m$^2$, 2.152 g/m$^2$ gelatin (half from original emulsion and half added), 0.968 g/m$^2$ Coupler 1 and 1 g/Ag mole 4-hydroxy-6-methyl- 1,3,3a,7-tetraazaindene ($Na^+$ salt). The emulsion layer was overcoated with 1.62 g/m$^2$ gelatin and 1.75 weight percent bis(vinylsulfonyl-)methane, based on total gelatin in the emulsion and overcoat layers.

The emulsion coatings were exposed for 1/100th second with 5500° K daylight through a Wratten™ 23A filter (>560 nm transmission) and processed for 3 minutes 15 seconds in a Kodak Flexicolor™ C41 color negative process. Speed was measured at 0.15 above minimum density. Sensitometric performance is summarized in Table XVII.

TABLE XVII

Dopant Speed Enhancements

| Emulsion | Dopant (mppm) | Profile % | Relative Log Speed |
|---|---|---|---|
| L | None | — | 210 |
| R | 110 | 60–100 | 223 |
| S | 110 | 60–80 | 222 |
| T | 220 | 0.2–80 | 228 |
| U | 220 | 60–80 | 229 |
| V | 440 | 0.2–80 | 233 |
| W | 880 | 0.2–80 | 233 |

From Table XVII it is apparent that the shallow electron trapping dopant increased speed from 0.13 log E to 0.23 log E.

It was additionally observed that a speed equal to that of the undoped control, Emulsion L, could be realized when a doped emulsion, Emulsion T, was processed for only 2 minutes. Photographic speeds of the coatings at the different processing times are summarized in Table XVIII.

TABLE XVIII

Retained Speed with Accelerated Development

| Emulsion | Rel. Log Speed 2' C41 | Rel. Log Speed 3'15" C41 |
|---|---|---|
| L | 193 | 210 |
| T | 210 | 228 |

From Table XVIII it is apparent that the dopant in Emulsion T allowed processing time to be reduced from 3 minutes, 15 seconds, to 2 minutes without any observed loss in speed. Thus, the speed advantage imparted by the shallow electron trapping dopant can be alternatively taken as development acceleration.

When the level of $K_4Ru(CN)_6$ increased above 400 mppm, an increase in minimum density was observed. It was observed, however, that this could be readily controlled by the addition of antifoggants. When an ultrathin tabular grain emulsion prepared similarly as Emulsions L through W above and containing 440 ppm $K_4Ru(CN)_6$ was coated with 20 mg/Ag mole 3-(2-methylsulfamoyl)benzothiazolium tetrafluoroborate antifoggant its minimum density was reduced by 0.07 as compared to an identical coating lacking the antifoggant. When an ultrathin tabular grain emulsion prepared similarly as Emulsions L through W above and containing 880 ppm $K_4Ru(CN)_6$ was coated with 1.55 mg/Ag mole 4-carboxymethyl- 4-thiazoline-2-thione antifoggant its minimum density was reduced by 0.29 as compared to an identical coating lacking the antifoggant. Thus, with antifoggants being useful to reduce minimum density it is apparent that relatively high concentrations of the shallow electron trapping dopants are useful and are capable of producing larger speed increases than would otherwise be feasible.

Combinations of Se and Shallow Electron Trap Dopants in Ultrathin Tabular Grains Emulsion X (Se and SET in host)

Six liters of distilled water with 7.5 g of oxidized methionine gelatin and 0.7 mL of antifoaming agent were added to a reaction vessel equipped with efficient stirring. The solution in the reaction vessel was adjusted to 45° C., pH 1.8 and pAg 9.1. For grain nucleation 12 mmol of $AgNO_3$ and 12 mmol of NaBr and KI (98.5:1.5 molar ratio) solutions were simultaneously added to the reaction vessel at constant flow rates over a period of 4 sec. The temperature was raised to 60° C. and 100 g of oxidized methionine gelatin 750 mL of distilled water were added to the solution. pH was adjusted to 5.85 with NaOH and pAg was adjusted to 8.9 at 60° C.

In a first growth period 0.81 mol of 1.6M $AgNO_3$ and 0.81 mol of 1.75M NaBr solutions were added to the reaction vessel at constant flow rates over a period of 40 minutes. The pAg of the liquid emulsion was adjusted to 9.2 with NaBr. In a second growth period precipitation was continued with the same 1.6M $AgNO_3$ and 1.75M NaBr solutions, except that the flow rates of each of the solutions was accelerated from 13 mL/min to 96 mL/min over a period of 57 minutes.

During the second growth period, following precipitation of 60% of total silver forming the ultrathin tabular grains and extending until 80% of the total silver forming the grain was precipitated, SET-2 [$K_4Ru(CN)_6$] in the amount of $2.2\times10^{-4}$ mole per silver mole and Se-2 [KSeCN] in the amount of $1.38\times10^{-6}$ mole per silver, each based on total silver forming the completed emulsion were added in the NaBr solution. During the second growth period of the precipitation and continuing until growth of the ultrathin tabular grain emulsion was complete an AgI Lippmann emulsion was also added at a flow rate regulated to maintain a molar ratio of Br:I at 97.4:2.6.

The ultrathin tabular grain emulsion contained silver iodobromide tabular grains (2.6M % I) having an average ECD of 2.14 μm and an average thickness of 0.052 μm. The tabular grains accounted for more than 97 percent of total grain projected area.

Epitaxial sensitization of the host ultrathin tabular grain emulsion was next undertaken by first adjusting the host emulsion to a pAg of 7.95 at 40° C., followed by the addition of 5 mmol/mole Ag of KI solution. Two spectral sensitizing dyes were added to the emulsion: anhydro-5,5'-dichloro-9-ethyl-3,3'-di(3 -sulfopropyl)thiacarbocyanine hydroxide triethylammonium salt (Dye 8) at 2.4 mmol/mole Ag and 5-di(1-ethyl- 2[1H]-β-naphthothiazolylidene)isopropylidene-1,3-di(β-methoxyethyl)barbituric acid (Dye 9) at 0.08 mmol/mole Ag. Epitaxial deposition was accomplished by the following additions: 32 mmol/mole Ag of NaCl, 24 mmol/Ag mole of NaBr, 9.6 mmol/mole Ag of AgI Lippmann emulsion and 1.0M $AgNO_3$ solution to finalize the pAg to 7.95 at 40° C. The silver halide epitaxy accounted for 6 mole percent of the host emulsion.

Finishing of the emulsion was undertaken by the addition of, for each mole of Ag, 60 mg of NaSCN, 9 μmol of the sulfur sensitizer dicarboxymethyldimethylthiourea, 2 or 3 μmol of the gold sensitizer auroustrimethyltriazolium thiolate, 5.7 mg of 1-(3 -acetamidophenyl)-5-mercaptotetrazole (APMT).

Emulsion Y (SET in host and Se in epitaxy)

The preparation procedure employed for Emulsion X was repeated, except that, instead of placing the selenium dopant in the host, the same amount of the selenium dopant was introduced into the silver halide epitaxy. Grain size characteristics were similar to those of Emulsion X, except that the grains of the ultrathin tabular grain emulsion prior to epitaxial deposition had an average ECD of 2.48 μm and an average thickness of 0.050 μm.

Sensitometric Evaluations

Samples of Emulsions X and Y were identically coated on a photographic film support and exposed for 1/100 second with a 365 nm light source. The coating format employed was emulsion (0.54 g Ag/m$^2$, 1.1 g/m$^2$ gelatin) blended with a mixture of 0.97 g/m$^2$ Coupler 1 and 1.1 g/m$^2$ gelatin, 1 g/Ag mole 4-hydroxy-6-methyl- 1,3,3a,7-tetraazaindene, sodium salt, surfactant, 1.6 g/m$^2$ gelatin, and 1.75 percent by weight, based on the weight of total gelatin, of bis(vinylsulfonyl)methane. The exposed samples were processed in 3 minutes 15 seconds in a Kodak Flexicolor™ C41 color negative process. Speeds were determined at a density of 0.15 above minimum density and are reported as relative log speeds (30 speed units= 0.3 log E). The results are summarized in Table XIX.

TABLE XIX

| | | Intrinsic Speeds | | | |
|---|---|---|---|---|---|
| Sulfur | Gold | Emulsion X | | Emulsion Y | |
| μmol/ mole Ag | μmol/ mole Ag | Dmin | Rel Speed | Dmin | Rel Speed |
| 9 | 2 | 0.06 | 100 | 0.07 | 292 |
| 9 | 3 | 0.06 | 100 | 0.08 | 264 |

The sensitometric evaluations were repeated with similar samples, except that instead of exposing with 365 nm radiation, each of the samples was exposed for 1/100 second with 5500° K daylight through a Wratten™ 23A filter (>560 nm transmission) and processed for 3 minutes 15 seconds in a Kodak Flexicolor™ C41 color negative process. Using additional samples a processing time of 4 minutes 30 seconds was employed, but the difference in processing times did not alter performance characteristics. The results are summarized in Table XX.

TABLE XX

| Sulfur | Gold | Minus Blue Speeds | | | |
|---|---|---|---|---|---|
| | | Emulsion X | | Emulsion Y | |
| μmol/ mole Ag | μmol/ mole Ag | Dmin | Rel Speed | Dmin | Rel Speed |
| 9 | 2 | 0.06 | 100 | 0.07 | 292 |
| 9 | 3 | 0.06 | 100 | 0.08 | 262 |

From Tables XIX and XX it is apparent that there is a significant speed advantage to be gained by locating one of the SET and Se sensitizers in the host ultrathin tabular grains and locating the remaining of the sensitizers in the silver halide epitaxy.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium, silver halide grains including tabular grains, said tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, and (e) exhibiting an average thickness of less than 0.07 μm, latent image forming chemical sensitization sites on the surfaces of the tabular grains, and a spectral sensitizing dye adsorbed to the surfaces of the tabular grains, wherein the surface chemical sensitization sites include silver halide protrusions of a face centered cubic crystal lattice structure forming epitaxial junctions with the tabular grains and having a higher overall solubility than at least that portion of the tabular grains forming epitaxial junctions with the protrusions, a sensitivity enhancing combination of dopants are contained in the silver halide grains including a first sensitivity enhancing dopant capable of providing shallow electron trapping sites and a second sensitivity enhancing selenium dopant, and, to enhance sensitivity, one of the first and second sensitivity enhancing dopants is restricted to the tabular grains and another of the first and second sensitivity enhancing dopants is restricted to the silver halide epitaxy.

2. An emulsion according to claim 1 wherein the tabular grains include at least 0.25 mole percent iodide, based on silver.

3. An emulsion according to claim 2 wherein the tabular grains are silver iodobromide grains.

4. An emulsion according to claim 1 wherein the silver halide epitaxy is comprised of silver chloride.

5. An emulsion according to claim 1 where the silver halide epitaxy is located on less than 50 percent of the tabular grain surfaces.

6. An emulsion according to claim 5 wherein the silver halide epitaxy is predominantly located adjacent at least one of the edges and corners of the tabular grains.

7. An emulsion according to claim 6 wherein the spectral sensitizing dye is an aggregated cyanine dye capable of acting as a site director for epitaxial deposition of the silver halide.

8. An emulsion according to claim 1 wherein the tabular grains account for greater than 97 percent of total grain projected area.

9. An emulsion according to claim 1 wherein the first sensitivity enhancing dopant is located in the tabular grains and the second sensitivity enhancing dopant is located in the silver halide protrusions.

10. An emulsion according to claim 1 wherein the dopant providing shallow electron trapping sites is a metal ion that displaces silver in the crystal lattice of the tabular grains, exhibits a positive valence of from 2 to 5, has its highest energy electron occupied molecular orbital filled and its lowest energy unoccupied molecular orbital at an energy level higher than the lowest energy conduction band of the silver halide crystal lattice forming the protrusions.

11. An emulsion according to claim 10 wherein the metal ion is zinc, cadmium, indium, lead or bismuth.

12. An emulsion according to claim 10 wherein the dopant providing shallow electron trapping sites is a coordination complex that (a) displaces ions in the silver halide crystal lattice of the tabular grains and exhibits a net valance more positive than the net valence of the ions it displaces, (b) contains at least one ligand that is more electronegative than any halide ion, (c) contains a metal ion having a positive valence of from +2 to +4 and having its highest energy electron occupied molecular orbital filled, and (d) has its lowest energy unoccupied molecular orbital at an energy level higher than the lowest energy conduction band of the silver halide crystal lattice forming the protrusions.

13. An emulsion according to claim 12 wherein the metal ion is chosen from among gallium, indium and a Group VIII metal ion.

14. An emulsion according to claim 1 wherein the spectral sensitizing dye exhibits an absorption peak at wavelengths longer than 430 nm.

15. An emulsion according to claim 14 wherein the spectral sensitizing dye is a green or red spectral sensitizing dye.

16. A photographic element comprised of a support, a first silver halide emulsion layer coated on the support and sensitized to produce a photographic record when exposed to specular light within the minus blue visible wavelength region of from 500 to 700 nm, and a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an emulsion according to any one of claims 1 to 15 inclusive.

* * * * *